US006936958B2

(12) United States Patent
Miyata et al.

(10) Patent No.: US 6,936,958 B2
(45) Date of Patent: Aug. 30, 2005

(54) DISPLAY DEVICE

(75) Inventors: Kenji Miyata, Hitachinaka (JP); Shigemi Hirasawa, Chiba (JP); Tomio Yaguchi, Sagamihara (JP); Yuuichi Kijima, Chousei (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/119,323

(22) Filed: Apr. 9, 2002

(65) Prior Publication Data

US 2002/0167265 A1 Nov. 14, 2002

(30) Foreign Application Priority Data

May 9, 2001 (JP) ..... 2001-138912

(51) Int. Cl.[7] ..... H01J 31/12; H01J 9/227

(52) U.S. Cl. ..... 313/497; 313/495; 313/496; 313/293; 313/336; 313/310

(58) Field of Search ..... 313/293, 294, 313/309–311, 336, 351, 495–497

(56) References Cited

U.S. PATENT DOCUMENTS

| | | | | |
|---|---|---|---|---|
| 3,453,478 A | | 7/1969 | Shoulders | |
| 3,787,106 A | * | 1/1974 | Schermerhorn | 445/25 |
| 5,194,780 A | * | 3/1993 | Meyer | 313/336 |
| 5,229,682 A | * | 7/1993 | Komatsu | 313/309 |
| 5,747,927 A | * | 5/1998 | Namikawa et al. | 313/495 |
| 5,773,834 A | | 6/1998 | Yamamoto et al. | |
| 5,804,920 A | * | 9/1998 | Khan et al. | 313/582 |
| 6,208,072 B1 | | 3/2001 | Watanabe et al. | |
| 6,380,671 B1 | * | 4/2002 | Lee | 313/495 |
| 6,593,682 B2 | * | 7/2003 | Jung et al. | 313/292 |

FOREIGN PATENT DOCUMENTS

| | | |
|---|---|---|
| JP | 9-221309 | 8/1997 |
| JP | 11- 144652 | 5/1999 |
| JP | 2000-21305 | 1/2000 |
| JP | 2000-251783 | 9/2000 |
| JP | 2000-323078 | 11/2000 |
| JP | 2001-23550 | 1/2001 |
| JP | 2001-043791 | 2/2001 |
| JP | 2001-035347 | 9/2001 |

* cited by examiner

*Primary Examiner*—Ashok Patel
*Assistant Examiner*—Sharlene Leurig
(74) *Attorney, Agent, or Firm*—Milbank, Tweed, Hadley & McCloy LLP

(57) ABSTRACT

A gap formed between cathode wires 2 (electron emitting sources 2*a*) and control electrodes 4 is made uniform and a gap formed between a rear panel 100 and a face panel 200 is held at a predetermined value with high accuracy. Plate-like members are used as the control electrodes 4. Holes 4*a* which allow electrons emitted from the electron emitting sources 2*a* provided to the cathode wires 2 to pass through the control electrodes 4 toward the face panel 200 side are formed in pixel regions which are defined by the cathode wires 2 and the control electrodes 4 crossing the cathode wires 2 both of which are formed on the rear panel 100. Contact portions 10 which are projected toward the rear panel 100 side and support the control electrodes 4 are provided between the neighboring cathode wires 2. Further, gap holding members 9 which hold the gap between the face panel 200 and the rear panel 100 at the predetermined value are provided right above the contact portions 10 and at the face panel 200 side.

15 Claims, 30 Drawing Sheets

DISPLAY DEVICE

BACKGROUND OF THE INVENTION

The present invention relates to a display device which utilizes an emission of electrons into a vacuum, and more particularly, to a display device which can enhance the display characteristics by enabling the stable control of an electron emission quantity by forming a gap between electron emitting sources and control electrodes which control the electron emission quantity from the electron emitting sources with high accuracy.

As a display device which exhibits the high brightness and the high definition, color cathode ray tubes have been widely used conventionally. However, along with the recent request for the higher quality of images of information processing equipment or television broadcasting, the demand for planar displays (panel displays) which are light in weight and require a small space while exhibiting the high brightness and the high definition has been increasing.

As typical examples, liquid crystal display devices, plasma display devices and the like have been put into practice. Further, particularly, as display devices which realize the higher brightness, it is expected that various kinds of panel-type display devices including a display device which utilizes an emission of electrons from electron emitting sources into a vacuum (hereinafter, referred to as "an electron emission type display device" or "a field emission type display device") and an organic EL display which is characterized by low power consumption will be commercialized.

Among such panel type display devices, as the above-mentioned field emission type display device, a display device having an electron emission structure which was invented by C. A. Spindt et al (for example, see U.S. Pat. No. 3,453,478, Japanese Laid-open Patent Publication 21305/2000), a display device having an electron emission structure of a metal-insulator-metal (MIM) type, a display device having an electron emission structure which utilizes an electron emission phenomenon based on a quantum theory tunneling effect (also referred to as "surface conduction type electron emitting source, see Japanese Laid-open Patent Publication 21305/2000), and a display device which utilizes an electron emission phenomenon having a diamond film, a graphite film and carbon nanotubes and the like have been known.

FIG. 38 is a cross-sectional view for explaining one constitutional example of a known field emission type display device. FIG. 39A and FIG. 39B are explanatory views showing constitutional examples of an electron emission source of one pixel and a control electrode which controls an electron emission quantity from the electron emission source, wherein FIG. 39A is a cross-sectional view and FIG. 39B is a plan view. The field emission type display device is constituted such that a sealing frame 300 is interposed to seal a space defined between both inner peripheries of a rear panel 100 which forms field-emission type electron emitting sources 2*a* and control electrodes 4 over an inner surface thereof and a face panel 200 which forms anodes 7 and fluorescent material layers 6 on an inner surface thereof which faces the above-mentioned rear panel 100, and the inside which is defined by the rear panel 100, the face panel 200 and the sealing frame 300 is reduced to a pressure lower than an atmospheric pressure of an external field or is evacuated (hereinafter referred to as "vacuum").

The rear panel 100 includes cathode wires 2 which have electron emitting sources 2*a* and the control electrodes 4 which are formed such that the control electrodes 4 cross the cathode wires 2 by way of an insulation layer 3 on the rear substrate 1 preferably made of glass or alumina or the like. Then, an electron emission quantity (including turning on or off of emission) from the electron emitting sources 2*a* are controlled in response to the potential difference between the cathode wires 2 and the control electrodes 4.

Further, the face panel 200 includes the anodes 7 and the fluorescent material layers 6 on a face substrate 5 formed of light-transmitting material such as glass. The sealing frame 300 is fixedly secured to the inner peripheries of the rear panel 100 and the face panel 200 using an adhesive agent such as frit glass. The inside defined by the rear panel 100, the face panel 200 and the sealing frame 300 is evacuated to a vacuum of $10^{-5}$ to $10^{-7}$ Torr, for example.

With respect to this type of display device whose inside is evacuated, to hold a gap between the rear panel 100 and the face panel 200, that is, a gap between the cathode wires 2 (electron emitting sources 2*a*) and the anodes 7 at a predetermined value, it is necessary to provide gap holding members 9 at portions except for a pixel region.

The insulation layer 3 is interposed between the cathode wires 2 formed on the rear panel 100 and the control electrodes 4 which cross the cathode wires 2 and an hole (grid hole) 4*a* is formed at each crossing portion of the cathode wire 2 and the control electrode 4. The hole 4*a* allows electrons emitted from the electron emitting source 2*a* to pass therethrough toward the anode 7 side. On the other hand, the electron emitting source 2*a* is formed on the above-mentioned crossing portion of the cathode wire 2 and the control electrode 4 and the insulation layer 3 is eliminated at a portion which corresponds to the hole 4*a* of the control electrode 4. The above-mentioned electron emitting sources 2*a* are constituted of carbon nanotubes (CNT), diamond-like carbon (DLC) or other field emission cathode, for example.

Here, as the electron emitting sources 2*a*, electron emitting sources which use carbon nanotubes are illustrated. As shown in FIG. 39A and FIG. 39B, the electron emitting source 2*a* is formed right below the hole 4*a* of the control electrode 4. Although the case in which one electron emitting source 2*a* is formed per one pixel is illustrated in FIG. 39A and FIG. 39B, a plurality of electron emitting sources 2*a* may be formed per one pixel.

FIG. 40A and FIG. 40B are explanatory views corresponding to FIG. 39A and FIG. 39B which show a display device forming a plurality of electron emitting sources per one pixel. Here, a plurality of holes 4*a* are formed in the control electrode 4 and a plurality of electron emitting sources 2*a* are arranged on a cathode wire 2 corresponding to respective holes 4*a*.

Electrons emitted from the rear panel 100 impinge on the fluorescent material layer 6 of the opposing face panel 200. Light which corresponds to the emitting characteristics of the fluorescent material layer 6 is irradiated to the outside of the face panel 200 so that a display device performs the function thereof.

As literatures which disclose the conventional technique related to this type of display device, for example, Japanese Laid-open Patent Publication 144652/1999, Japanese Laid-open Patent Publication 323078/2000 and the like are named.

FIG. 41 is an enlarged cross-sectional view of one pixel portion for explaining a constitutional example of a rear panel of a conventional field emission type display device. In such a display device of this type, with respect to a rear panel 100, cathode wires 2 are formed on a rear substrate 1 by a thin film patterning technique or the like, an insulation layer 3 having a given thickness is formed on the cathode wires 2, and the insulation layer 3 corresponding to pixel portions are removed. Then, control electrodes 4 are formed on the insulation layer 3 by a vapor deposition method or a sputtering method except for holes 4*a*.

Since the insulation layer 3 is formed by coating resin material using a screen printing method, it is difficult to make a thickness of the insulation layer 3 uniform. Accordingly, it is impossible to obtain the uniform thickness with no irregularities over the entire surface of the display region. Since the control electrodes 4 are formed along the surface contour of the insulation layer 3, as emphasized in conjunction with FIG. 41, the irregularities are generated with respect to a gap defined between the cathode wires 2 and the control electrodes 4 due to the irregularities of the thickness of the insulation layer 3. It is necessary to control the gap between the cathode wires 2 and the control electrode 4 at a $\mu$m level because the irregularities of the gap in the peripheries of the holes 4*a* of the control electrode 4 bring about the irregularities of electron emission abilities of individual pixels.

Further, since the insulation layer 3 is disposed between the crossing portions of the cathode wires 2 and the control electrodes 4, the capacitance is generated. The irregularities of the thickness of the insulation layer 3 lead to the irregularities of the capacitance and when the thickness of the insulation layer 3 is increased, this obstructs the high-frequency driving. Accordingly, the thinner the thickness of the insulation layer 3, the high-frequency driving is improved and hence, it is ultimately desirable to have the constitution which can eliminate the insulation layer 3.

Then, in this type of display device, as has been explained in conjunction with FIG. 38, it is necessary to provide the gap holding members 9 to hold the gap between the rear panel 100 and the face panel 200 to the predetermined value. This is because that when the gap between the rear panel 100 and the face panel 200 is changed, the brightness of individual pixels becomes uneven so that it is difficult to obtain a reliable display device. However, the conventional technique is less than optimal with respect to these matters in using the display device in an actual use and these matters constitute drawbacks to be solved.

Accordingly, it is an object of the present invention to provide a display device exhibiting high reliability which can solve the above-mentioned various problems of the conventional techniques and can realize the electron emission characteristics and the high-frequency driving of high performance by adopting a constitution in which a gap formed between cathode wires 2 (electron emitting sources 2*a*) and control electrodes 4 can be made uniform and a gap formed between a rear panel 100 and a face panel 200 can be held at a predetermined value with high accuracy.

SUMMARY OF THE INVENTION

To achieve the above-mentioned object, a display device according to the present invention uses plate-like members as control electrodes and also arranges gap holding members right above the control electrodes.

Further, to achieve the above-mentioned object, the display device according to the present invention constitutes the control electrodes by forming holes in plate-like members and a gap formed between cathode wires and the control electrodes is regulated by a plate-thickness direction size of the holes.

Further, in the present invention, by interposing the gap holding members having an approximately plate-like shape between the rear panel and the face panel with high reliability, the gap can be held at a predetermined value with high accuracy.

Further, in the present invention, the capacitance can be reduced by removing or minimizing an insulation layer interposed between the control electrodes and the cathode wires. Further, at the cathode-wire sides of the control electrodes including hole forming portions or portions except for the hole forming portions, that is, an hole forming region, large-diameter openings (recessed portions) which regulate the gap between the holes and the cathode wires are formed by etching or the like, or the gap between the holes through which a flow of electrons pass and the cathode wires is controlled. To list the fundamental constitutions of the present invention, they are as follows.

(1) In a display device comprising a rear panel having a plurality of cathode wires having electron emitting sources, a plurality of control electrodes which cross the cathode wires and control an emission quantity of electrons from the electron emitting sources in response to the potential difference between the cathode wires and the control electrodes and a rear substrate, and a face panel having anodes and fluorescent materials, the control electrodes are formed of plate-like members, the control electrodes have holes which allow the electrons emitted from the electron emitting sources to pass therethrough toward the face panel side in pixel regions where the control electrodes cross the cathode wires, the control electrodes include contact portions which are projected toward the rear panel side between the neighboring cathode wires and support the control electrodes and gap holding members hold a gap formed between the face panel and the rear panel to a predetermined value right above the contact portions of the control electrodes and at the face panel side.

(2) In the constitution (1), the contact portions include first contact portions and second contact portions and the gap holding members are provided right above the first contact portions of the control electrodes and at the face panel side.

(3) In the constitution (1) or (2), the control electrodes include grooves into which ends of the gap holding members are fitted right above the contact portions of the control electrodes and at the face panel side.

(4) In any one of the constitutions (1) to (3), the cathode wires are divided in two or more in the pixel region, the control electrodes have third contact portions which are projected to the rear panel side and support the control electrodes, and the third contact portions are arranged between the divided cathode wires.

(5) In any one of the constitutions (1) to (3), the cathode wires have an opening in the pixel region, the control electrodes have third contact portions which are projected to the rear panel side and support the control electrodes, and the third contact portions are arranged in the opening formed in the cathode wires.

(6) In any one of the constitutions (1) to (5), the control electrodes and the gap holding members are fixed to each other by an adhesive agent or an anodic bonding.

(7) In any one of the constitutions (1) to (6), at least portions of respective contact portions of the control electrodes are fixed to the rear panel by an adhesive agent or an anodic bonding.

(8) In any one of the constitutions (1) to (7), the gap holding members are supported at a given interval from each other by a support member which crosses the cathode wires.

(9) In the constitution (8), the support member has cuts into which side peripheries of the gap holding members extending in the gap holding direction are fitted.

(10) In the constitution (8), the support member is arranged between the control electrodes and at positions where the control electrodes cross the gap holding members and have cuts into which side peripheries of the gap holding members at the cathode-wire side are fitted.

(11) In any one of the constitutions (1) to (10), the each gap holding member has plate-like portions which are arranged parallel to the cathode wires and the control electrodes respectively among neighboring pixel regions and has an approximately cruciform cross section on a plane of a direction parallel to the cathode wires and the control electrodes.

(12) In any one of the constitutions (1) to (11), the contact portions are brought into contact with the rear substrate.

(13) In any one of the constitutions (1) to (11), an insulation layer is interposed between the contact portions and the rear substrate.

(14) In any one of the constitutions (1) to (13), recessed portions are formed in the cathode wire sides of the control electrodes including hole forming regions.

(15) In the constitution (14), a width of the recessed portions is set smaller than a width of the control electrodes and an insulation layer is interposed between portions of the control electrodes other than the recessed portions and the cathode wires.

(16) In any one of the constitutions (1) to (15), a tension is applied to the control electrodes in the longitudinal direction of the control electrodes.

Due to the above-mentioned respective constitutions, the contact portions of the control electrodes made of plate-like members which are projected toward the rear panel side are brought into pressure contact with the rear substrate so that the gap formed between the cathode wires and the control electrodes is regulated to a given value and the control electrodes can effectively cope with an air pressure applied from both sides of the rear panel and the face panel.

Further, since the gap holding members are arranged right above the control electrodes made of the plate-like members, the control electrodes made of the plate-like members can be firmly fixed. It is preferable to position the control electrodes right above the contact portions.

Further, by increasing the contact portions or by fixing the control electrodes using an adhesive agent, the control electrodes can further effectively cope with an air pressure applied from both sides of the rear panel and the face panel and, at the same time, can enhance the reliability thereof.

Further, by interposing an adhesive agent between the contact surfaces or by fitting the gap holding members into the grooves formed in the control electrodes and fixing the peripheries of the grooves using an adhesive agent, they can be fixed to each other more reliably and firmly so that the machining irregularities of the gap holding members and the control electrodes can be absorbed and the gap holding members can be fixed firmly whereby the reliability can be enhanced and, at the same time, the change of the electron emission ability can be eliminated thus enabling the acquisition of the image display of high quality.

The gap holding member having an approximately cruciform cross section per se has the self standing ability so that by mounting the gap holding member to given portions in the pixel region, it is possible to hold the gap formed between the face panel and the rear panel at a predetermined value.

Further, by fixing the gap holding member using the support member, it is possible to surely make the gap holding member stand in an erected manner and it is also possible to surely hold the gap formed between the face panel and the rear panel at a predetermined value.

Further, by providing large-diameter openings (recessed portions) which regulate the gap between the holes and the cathode wires at the cathode wire side of the control electrode including the hole forming region, the gap between the holes of the control electrodes and the cathode wires can be adjusted based on a depth of the large-diameter openings so that the gap can be accurately set.

Further, by assembling the control electrodes to the rear panel while applying a tension to the control electrodes in the longitudinal direction of the control electrodes, the flatness of the control electrodes can be guaranteed and the gap formed between the holes and the cathode wires can be uniformly set.

In the above-mentioned explanation and the description of embodiments which will be explained later, unless otherwise specified, the cathode wires include electron emitting sources. Further, the gap formed between the control electrodes and the cathode wires means the gap formed between the holes of the control electrodes and the cathode wires (electron emitting sources).

Further, it is needless to say that the present invention is not limited to the above-mentioned constitutions and constitutions which will be described later and various modifications are conceivable without departing from the technical concept of the present invention.

BRIEF DESCRIPTION OF THE DRAWINGS

FIG. 3A and FIG. 3B are explanatory views of an essential structure of FIG. 1, wherein FIG. 3A is a plan view as viewed in the I–J direction of FIG. 1 and FIG. 3B is a cross-sectional view taken along a line A–A' of FIG. 3A.

FIG. 9A and FIG. 9B are explanatory views of a third embodiment of the display device according to the present invention, wherein FIG. 9A is a plan view of an essential part and FIG. 9B is a cross-sectional view taken along a line A–A' of FIG. 9A.

FIG. 34A to FIG. 34C are structural views of a gap holding member and a rear panel for explaining a ninth embodiment according to the present invention, wherein FIG. 34A is a plan view, FIG. 34B is a cross-sectional view taken along a line P–Q of FIG. 34A, and FIG. 34C is a cross-sectional view taken along a line R–S of FIG. 34A.

FIG. 35A to FIG. 35C are structural views of a gap holding member and a rear panel for explaining a tenth embodiment according to the present invention, wherein FIG. 35A is a plan view, FIG. 35B is a cross-sectional view taken along a line P–Q of FIG. 35A, and FIG. 35C is a cross-sectional view taken along a line R–S of FIG. 35A.

FIG. 36A to FIG. 36C are structural views around a control electrode for explaining an eleventh embodiment according to the present invention, wherein FIG. 36A is a plan view and FIG. 36B and FIG. 36C are cross-sectional views taken along a line A–A' of FIG. 36A.

FIG. 39A and FIG. 39B are explanatory views of constitutional examples of electron emitting sources in one pixel and control electrodes which control an electron emitting quantity from the electron emitting sources wherein FIG. 39A is a cross-sectional view and FIG. 39B is a plan view.

DESCRIPTION OF THE PREFERRED EMBODIMENTS

Preferred embodiments of the present invention are explained in detail hereinafter in conjunction with drawings which show these embodiments.

Figure 1:
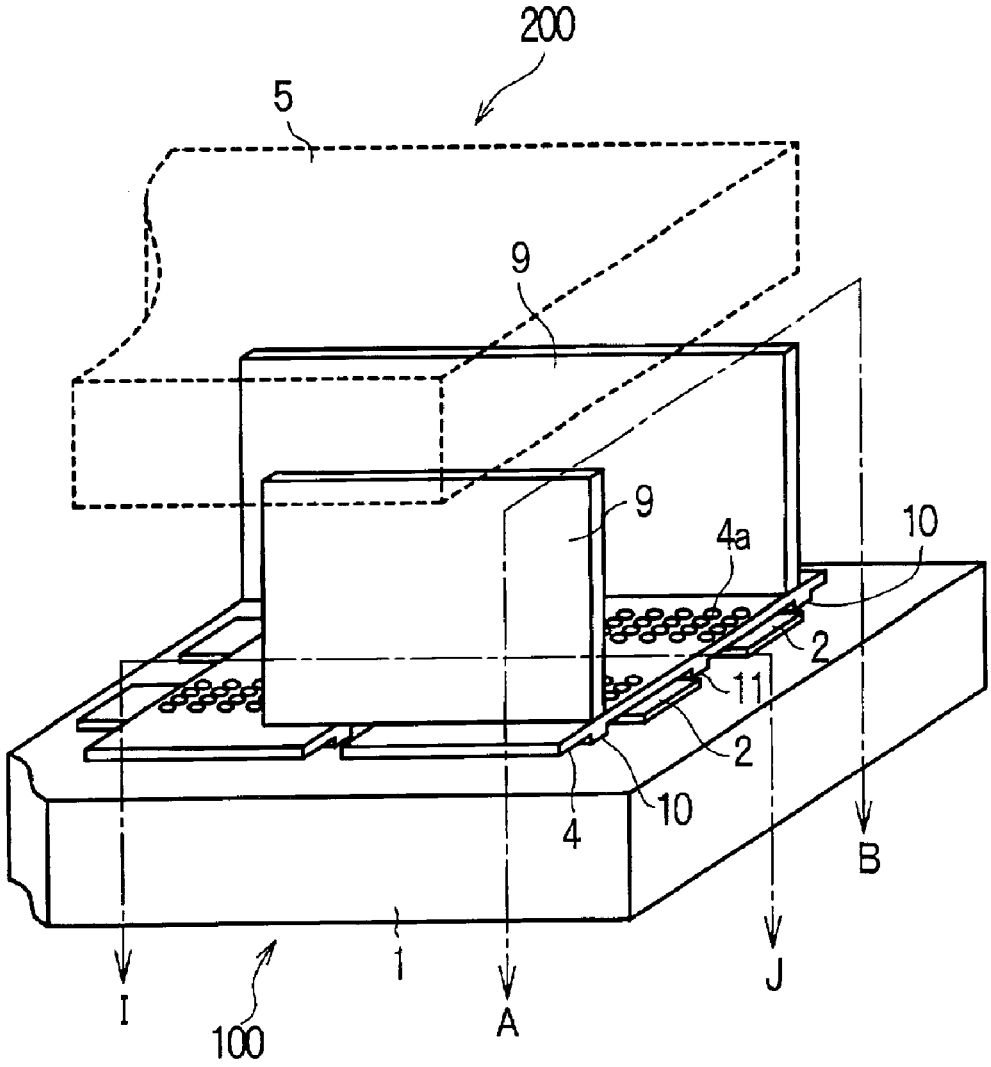
FIG. 1 is a perspective view for explaining a mounting structure of a gap holding member disposed between a rear panel and a face panel for explaining a first embodiment of the display device according to the present invention.
Figure 2:
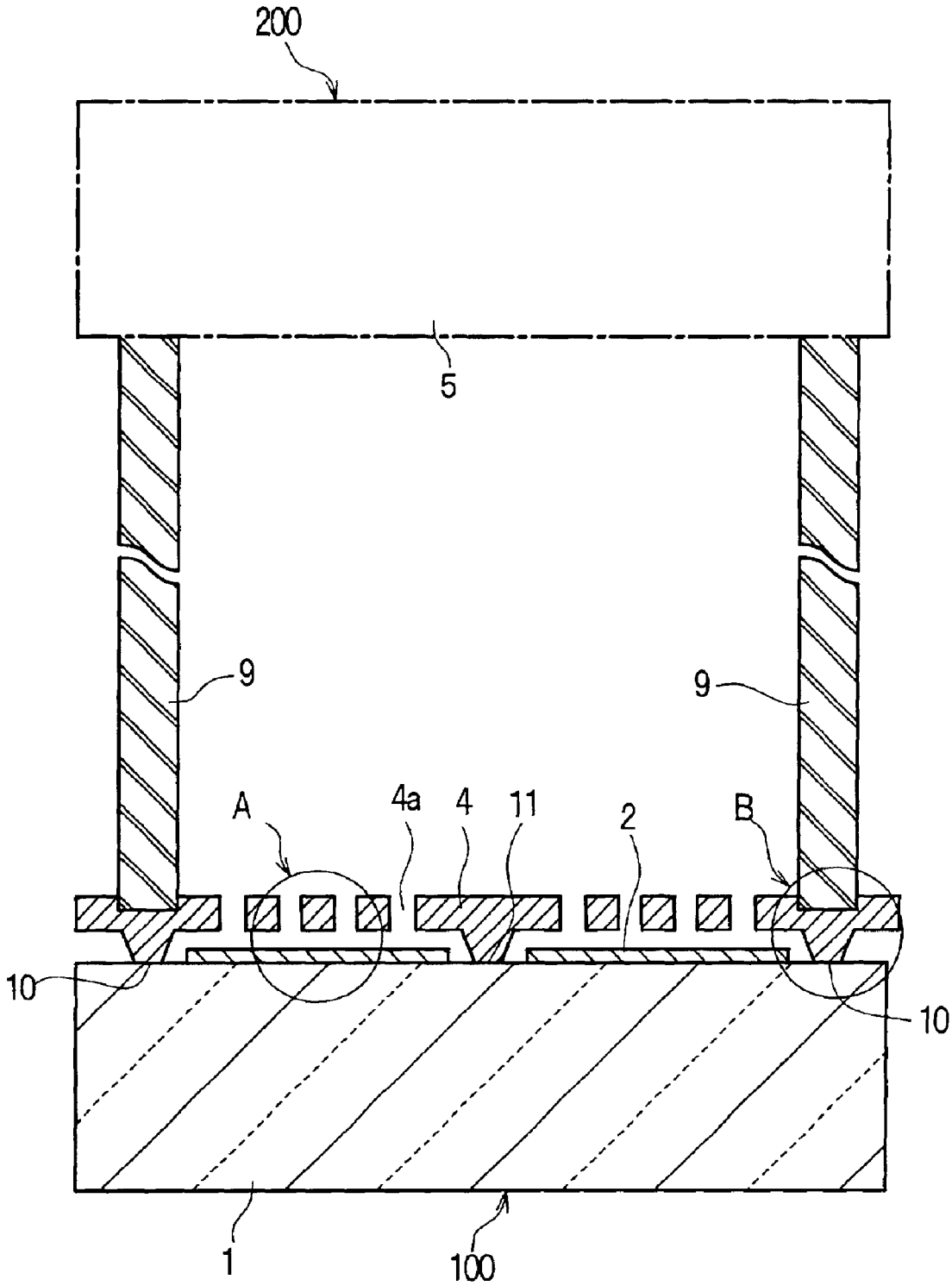
FIG. 2 is a cross-sectional view taken along a line A–B of FIG. 1.
Figure 3A:
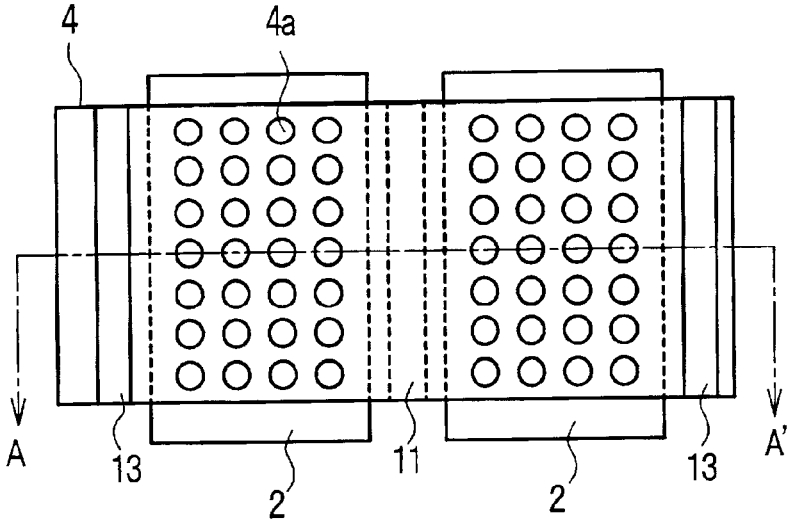
Figure 3B:
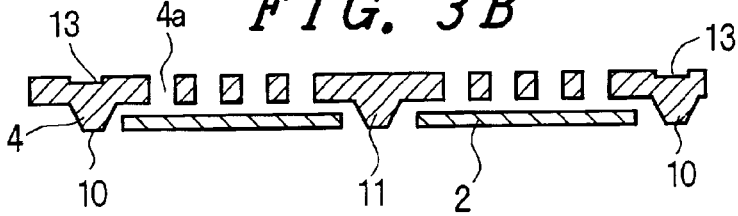

FIG. 1 is a perspective view for explaining a mounting structure of gap holding members provided between a rear panel and a face panel for explaining a first embodiment of the display device according to the present invention. FIG. 2 is a cross-sectional view taken along a line A–B of FIG. 1 and FIG. 3A and FIG. 3B are explanatory views of a structure of an essential part in FIG. 1, wherein FIG. 3A is a plan view as viewed from the I–J direction of FIG. 1 and FIG. 3B is a cross-sectional view taken along a line A–A' of FIG. 3A. In this embodiment, each control electrode 4 is constituted of, for example, a plate-like member, that is, a plate member formed of a single plate or a two-or-more composite plate and is formed of an iron plate or an alloy plate of a relatively large plate thickness containing iron as a main component. Further, in this embodiment, an insulation layer 3 is not provided between the control electrodes and cathode wires 2.

That is, as shown in FIG. 1 to FIG. 3B, the control electrode 4 is mounted such that the control electrode 4 is floated spatially with respect to the cathode wires 2 which are formed on a rear substrate 1 constituting a rear panel 100. Although it is preferable to set the plate thickness of the control electrode 4 to approximately 10 $\mu$m to 500 $\mu$m, the plate thickness is not limited to such a value. Although electron emitting sources 2*a* formed of carbon nanotubes, carbon fibers or the like are formed on the cathode wires 2, they are omitted from the drawings.

On an inner surface of the rear substrate 1 which constitutes the rear panel 100, a plurality of cathode wires 2 and a plurality of control electrodes 4 are formed in an crossing manner and one pixel is formed at each crossing portion. The control electrode 4 has a plurality of holes 4*a* per one pixel and has first contact portions 10 and second contact portions 11 having a projection shape at the rear substrate 1 side at portions thereof which are brought into contact with the rear substrate 1.

The first contact portions 10 and the second contact portions 11 are fixed to the rear substrate 1 directly or using a second adhesive agent 15 which will be explained later. Further, to a side of the control electrode 4 opposite to the first contact portions 10, gap holding members 9 are fixed directly or using a first adhesive agent 14 which will be explained later. The first contact portion 10 and the second contact portion 11 are formed between a plurality of cathode wires 2 and the second contact portion 11 is formed at a portion where the gap holding member 9 is not present. With respect to the number of mounting of the gap holding members 9, since the gap holding members 9 are mounted among whole pixels or between arbitrary pixels, the number depends on the size and the like of the display device.

The rear substrate 1 may be formed of a metal plate which has a surface thereof covered with inorganic insulation material, glass, quartz or insulation material or the like. Although it is preferable to set a plate thickness of the rear substrate 1 to approximately 0.5 mm to 3 mm, the plate thickness is not limited to such a value.

Although anodes 7 and fluorescent materials 6 are formed on an inner surface of the face panel 200, they are omitted from the drawing. The gap holding members 9 which define a gap formed between the face panel 200 and the rear panel 100 which face each other in an opposed manner are formed of a metal plate which has a surface thereof covered with inorganic insulation material, glass, quartz or insulation material or the like.

Although the gap holding members 9 are formed of simple plate-like members which are referred to a so-called rib structure in this embodiment, members having various shapes such as members having a so-called cross-structure which is also provided with ribs in the different direction in a plan view can be used as will be explained later.

The spatial positional relationship between the control electrodes 4 and the cathode wires 2 which largely influences the driving characteristics of a display device of this kind can be realized by performing a precision machining of the control electrodes 4. When the control electrodes 4 are constituted of metal plates, holes 4*a* may be machined accurately by adopting etching based on a photolithography technique which uses a photosensitive resist.

The control electrodes 4 have portions of lower surfaces thereof brought into contact with the rear substrate 1 directly or by way of an adhesive agent and have portion of upper surfaces thereof brought into contact with the gap holding members 9 directly or by way of an adhesive agent. Here, it is possible to hold the gap holding members 9 on the control electrodes 4 by forming grooves 13 in the control electrodes 4 and fitting the gap holding members 9 in these grooves 13. As shown in FIG. 3A, holes 4*a* for allowing electrons to pass therethrough which are formed in the control electrode 4 are arranged in a quadratic array.

The gap holding members 9 have upper portions thereof brought into contact with the face substrate 5 directly or by way of an adhesive agent so that the gap holding members 9 can firmly support the rear panel 100 and the face panel 200 whereby the gap defined between the rear panel 100 and the face panel 200 which face each other in an opposed manner can be held at a given value with high accuracy against an atmospheric pressure applied to an external surface of the display device.

In the display device of this embodiment, since no insulation layer 3 is interposed in a space defined between the cathode wires 2 and the control electrodes 4 and the space is evacuated, the capacitance between both electrodes is minimized. As a result, it is possible to input high-frequency control signals so that a display device having a large screen and a high definition can be easily realized.

Further, since the rear substrate 1 and the control electrodes 4 can be machined as separates parts, they can be assembled after fabricating them using optimum machining methods respectively whereby the productivity can be enhanced. For example, the control electrodes 4 are separately formed by etching or by laminating two or more members. The details of portion A and portion B shown in FIG. 2 are explained later.

Figure 4:
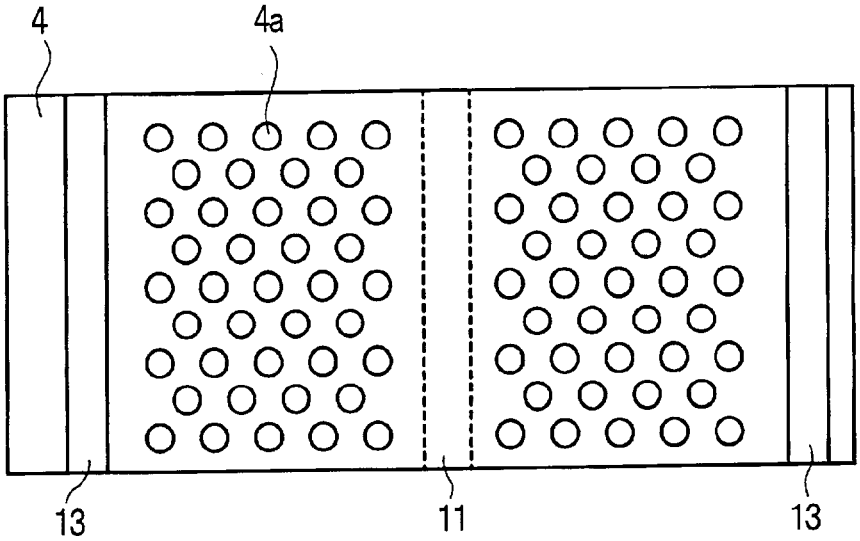
FIG. 4 is a plan view for explaining another shape of a control electrode used in the first embodiment of the display device according to the present invention shown.

FIG. 4 is a plan view for explaining another shape of the control electrode 4 used in the first embodiment of the display device according to the present invention shown in FIG. 1. Although the hole 4*a* formed in the control electrodes 4 are arranged in a quadratic array in FIG. 3A, the holes 4*a* are arranged in a so-called delta array in the control electrode 4 shown in FIG. 4.

By forming the holes 4*a* in a circular shape in the same manner as FIG. 3, the high machining accuracy and the high strength holding ability can be achieved. Further, by adopting the delta array in the arrangement of the holes 4*a* as shown in FIG. 4, the ratio of the whole hole area of a plurality of holes 4*a* with respect to the area of the control electrode 4, that is, the numerical aperture can be increased compared to the arrangement of holes shown in FIG. 3A so that the large electron emission ability can be obtained.

Figure 5:
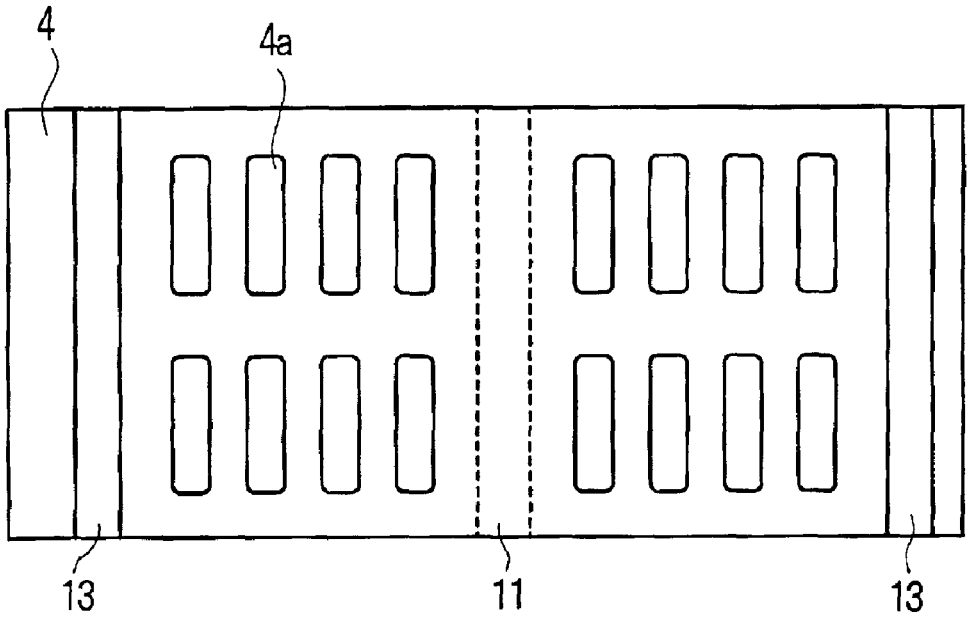
FIG. 5 is a plan view for explaining still another shape of a control electrode used in the first embodiment of the display device according to the present invention.

FIG. 5 is a plan view showing still another shape of the control electrodes used in the first embodiment of the display device according to the present invention shown in FIG. 1. The holes 4*a* formed in the control electrode 4 have an approximately rectangular shape having a long axis in a direction which crosses the longitudinal direction of the control electrode 4 at a right angle. By forming holes 4*a* having such a shape, the numerical aperture can be further increased so that the larger electron emission ability can be achieved.

Figure 6:
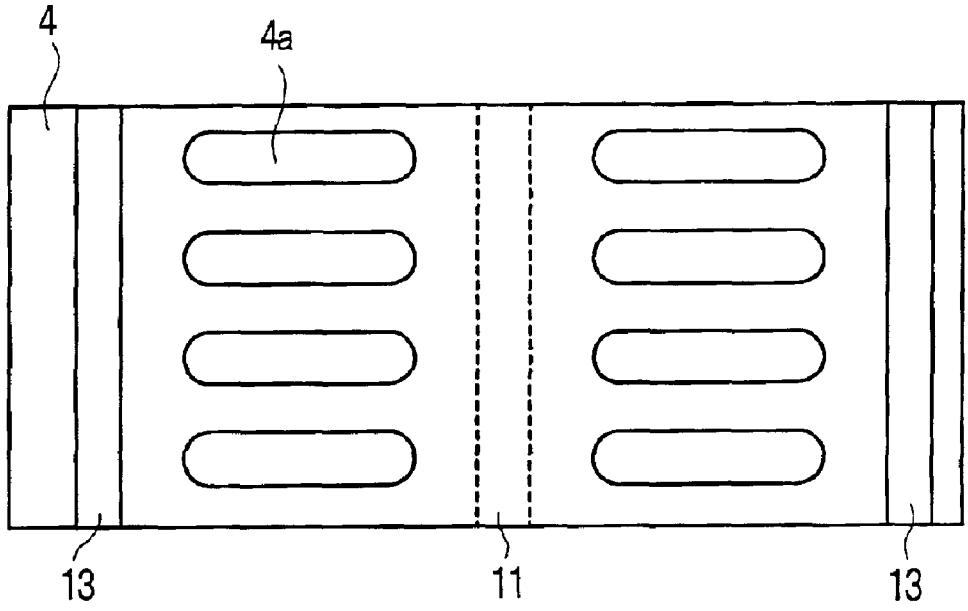
FIG. 6 is a plan view for explaining a further shape of a control electrode used in the first embodiment of the display device according to the present invention.

FIG. 6 is a plan view for explaining a further shape of the control electrodes used in the first embodiment of the display device according to the present invention shown in FIG. 1. The holes 4*a* formed in the control electrode 4 have an approximately rectangular shape having a long axis in a direction parallel to the longitudinal direction of the control electrode 4. By forming holes 4*a* having such a shape, the numerical aperture can be further increased in the same manner as the control electrode 4 shown in FIG. 5 so that the larger electron emission ability can be achieved and, at the same time, the deformation of the holes 4*a* when the tension in the longitudinal direction is applied to the control electrode 4 can be reduced compared to the control electrode 4 shown in FIG. 5.

Figure 7:
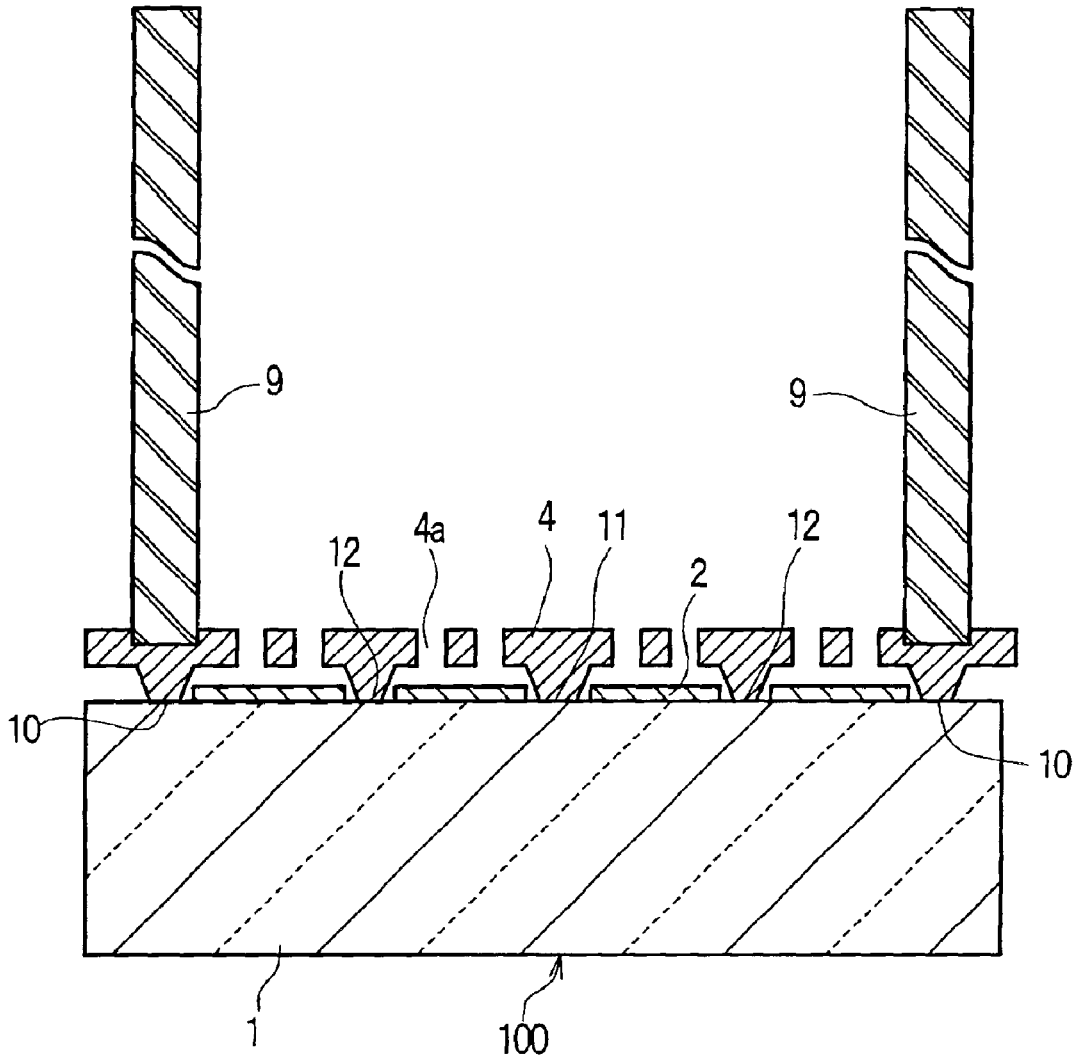
FIG. 7 is a cross-sectional view similar to FIG. 2 for explaining a mounting structure of gap holding members provided between a rear panel and a face panel for explaining a second embodiment of the display device according to the present invention.
Figure 8A:
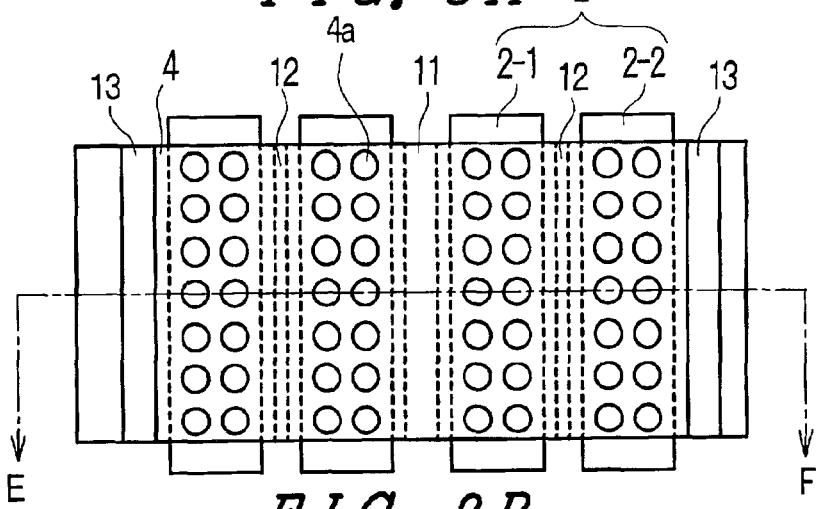
FIG. 8A and FIG. 8B are a plan view of an essential part and a cross-sectional view similar to FIG. 3A and FIG. 3B which explain the second embodiment of the display device according to the present invention.
Figure 8B:
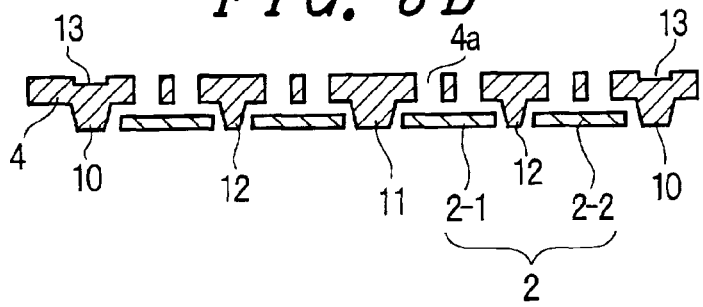

FIG. 7 is a cross-sectional view similar to that of FIG. 2 for explaining the mounting structure of gap holding members 9 provided between a rear panel and a face panel for explaining a second embodiment of the display device of the present invention. Further, FIG. 8A to FIG. 8B are a plan view of an essential part and a cross-sectional view similar to those of FIG. 3A and FIG. 3B. Here, the face panel 200 is omitted from the drawing.

In this embodiment, cathode wires 2 in one pixel are divided in halves, that is, a cathode wire 2-1 and a cathode wire 2—2 in the longitudinal direction and a third contact portion 12 of a control electrode 4 is positioned between the cathode wires 2-1, 2—2. Holes 4*a* formed in the control electrode 4 are formed such that they belong to pixel ranges of the respective cathode wires 2-1, 2—2 formed in halves.

In this embodiment, by bringing the control electrode 4 into contact with the rear substrate 1 at three contact portions, that is, the first, the second and the third contact portions, a gap formed between both electrodes can be held with high accuracy. Here, although gap holding members 9 are provided at positions corresponding to both ends of the pixel, it is not always necessary to provide the gap holding members 9 for each pixel and, as mentioned previously, the gap holding members 9 may be provided for every several other pixels.

Figure 9A:
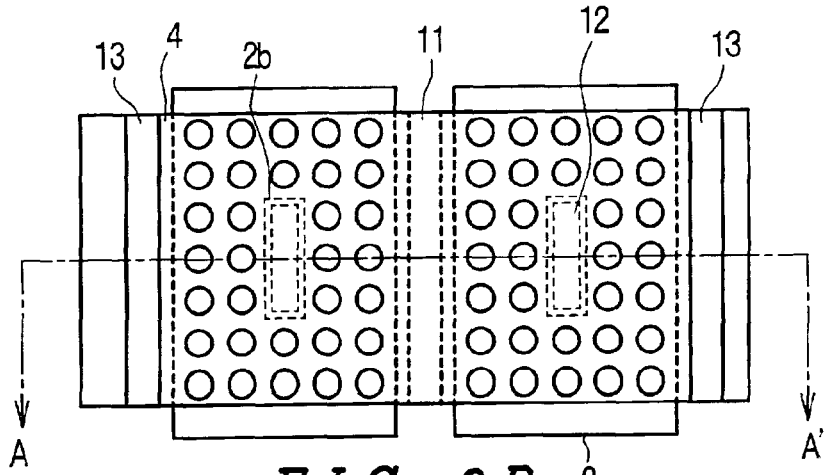
Figure 9B:
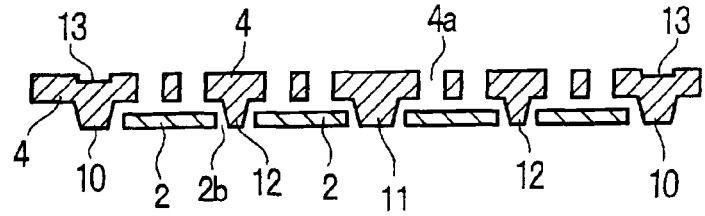

FIG. 9A and FIG. 9B are explanatory views of a third embodiment of the display device according to the present invention, wherein FIG. 9A is a plan view of an essential part, FIG. 9B is a cross-sectional view taken along a line A–A' of FIG. 9A. In this embodiment, openings 2*b* are formed in cathode wires 2 and third contact portions 12 which are formed on a lower surface of a control electrode 4 are disposed in the openings 2*b* and are locally arranged in a pixel. By locally arranging the third contact portions 12 in the pixel, compared to the first embodiment, contact portions formed between the control electrode 4 and a rear substrate 1 are increased so that a gap formed between the control electrode 4 and the rear substrate 1 can be set with high accuracy and, at the same time, the larger electron emission area can be achieved compared to the above-mentioned second embodiment.

Figure 10:
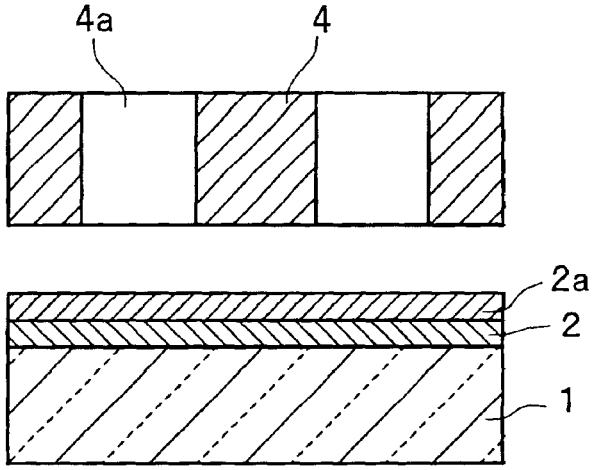
FIG. 10 is an explanatory view of a constitutional example of a portion of the display device according to the present invention which is surrounded by A in FIG. 2.

FIG. 10 is an explanatory view of one constitutional example of the portion surrounded by A in FIG. 2 showing the display device of the present invention. Cathode wires 2 are formed by printing a paste containing conductive material preferably made of silver powder onto a rear substrate 1 and by baking the paste. On the cathode wires 2, electron emitting sources 2*a* are formed by coating conductive material containing ultra-fine needle-like material such as carbon nanotubes or carbon fibers on the cathode wires 2.

The electron emitting source 2*a* has a function of emitting electrons when an electric field is applied thereto. Holes 4*a* formed in the control electrode 4 fall within an area of the electron emitting source 2*a*. In this manner, by separately forming and laminating the cathode wire 2 and the electron emitting source 2*a* to each other, it is possible to select and use optimum materials to the cathode wire 2 and the electron emitting source 2*a* respectively.

Figure 11:
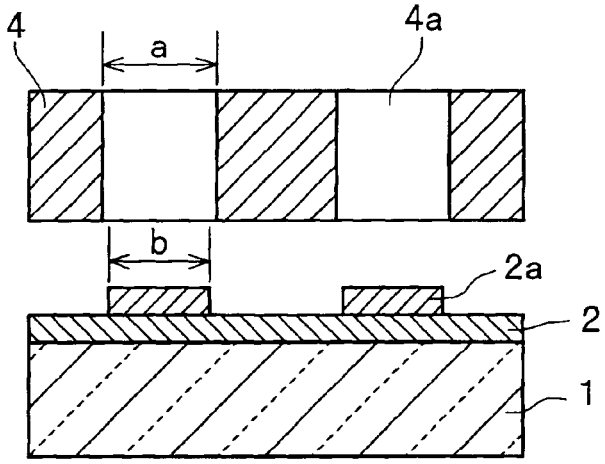
FIG. 11 is an explanatory view of another constitutional example of a portion of the display device according to the present invention which is surrounded by A in FIG. 2.

FIG. 11 is an explanatory view of another constitutional example of a portion which is surrounded by A in FIG. 2 of the display device of the present invention. Here, the electron emitting sources 2*a* explained in conjunction with FIG. 10 are formed in ranges in which the electron emitting sources 2*a* fall within areas of holes 4*a* of a control electrode 4. Due to such a constitution, the undesired electron emission can be eliminated and the expensive electron emitting source material can be saved.

To be more specific, by narrowing a size "b" of the electron emitting source 2*a* than a size "a" of the holes 4*a* in FIG. 11, the travelling disturbance of electrons derived from the sharp change of an electric field generated in the vicinity of end peripheries of the hole 4 can be suppressed so that the degradation of image quality due to the diffusion of undesired electrons can be prevented.

Figure 12:
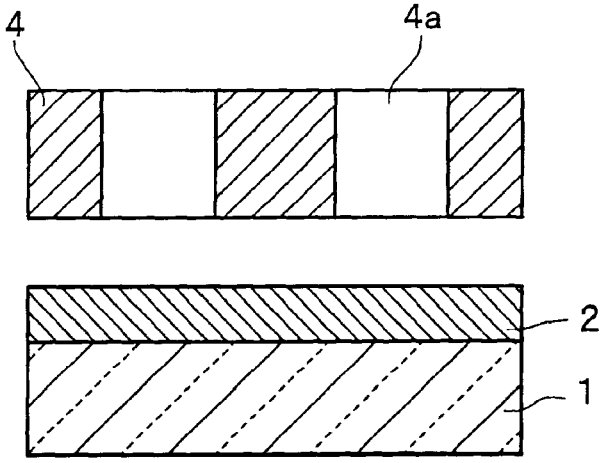
FIG. 12 is an explanatory view of still another constitutional example of a portion of the display device according to the present invention which is surrounded by A in FIG. 2.

FIG. 12 is an explanatory view of still another constitutional example of a portion which is surrounded by A in FIG. 2 of the display device of the present invention. In this constitutional example, an electron emitting source is integrally formed with a cathode wire 2 such that the cathode wire 2 has a function of the cathode wire and a function of the electron emitting source. For example, a paste into which silver powdery particles and carbon nanotubes are mixed is printed on a rear substrate 1 to form the cathode wire 2. Due to such a constitution, the cathode wire 2 which exhibits low electric resistance and can obtain the sufficient electron emission can be formed so that it is possible to provide a display device which can facilitate the fabrication thereof and has a simplified structure.

Figure 13:
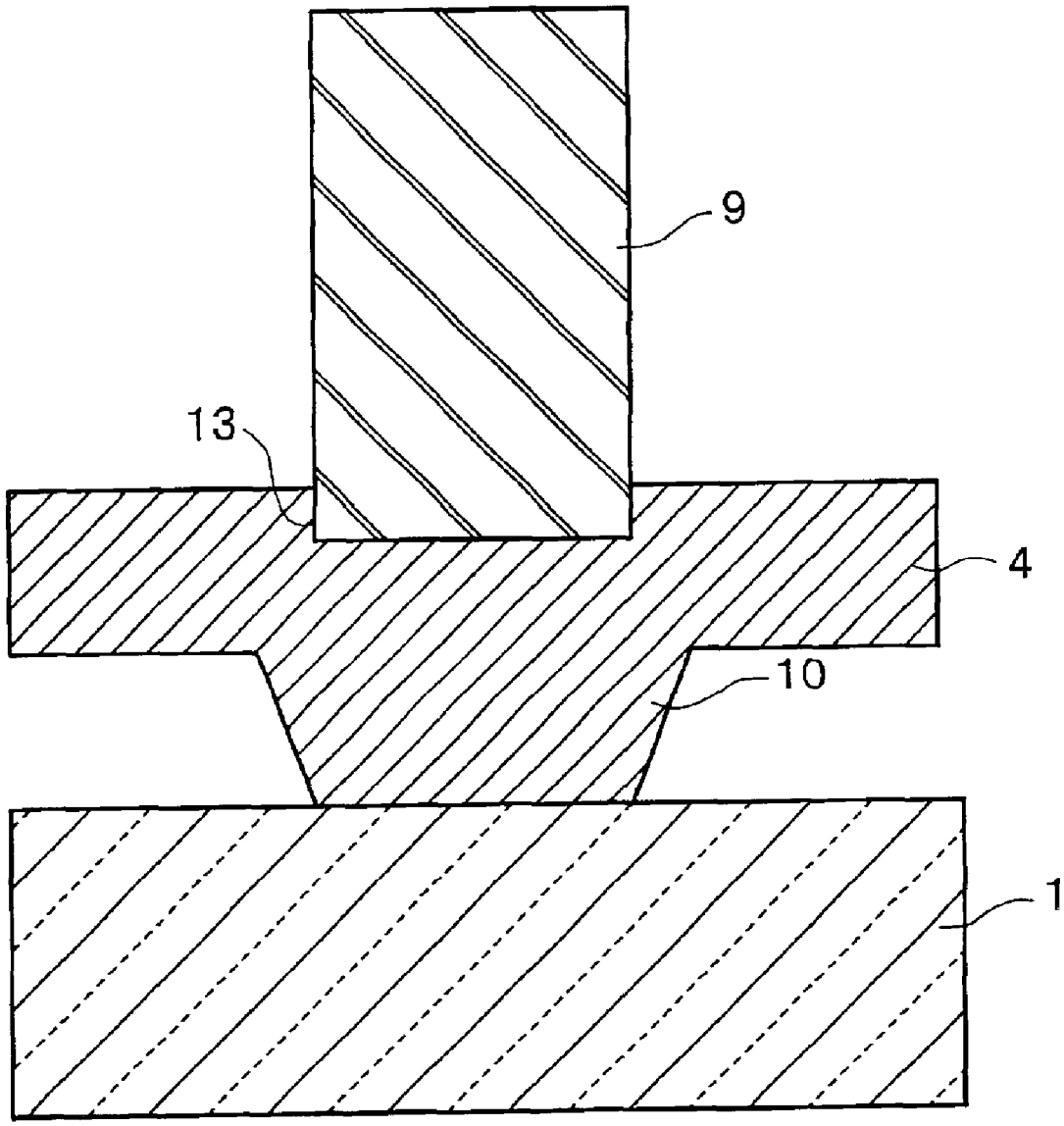
FIG. 13 is an explanatory view of a constitutional example of a portion of the display device according to the present invention which is surrounded by B in FIG. 2.

FIG. 13 is an explanatory view of a constitutional example of a portion which is surrounded by B in FIG. 2 of the display device of the present invention. In this constitution, a first contact portion 10 of a control electrode 4 is brought into contact with a rear substrate 1 and a lower end of a gap holding member 9 is fitted into a groove 13 formed in a side of the control electrode 4 opposite to the rear substrate 1.

The gap holding member 9 has a function of holding a gap between a face panel 200 and a rear panel 100 to a predetermined value as well as a function of firmly holding the control electrode 4 to the rear substrate 1 by bringing the control electrode 4 into contact with the rear substrate 1 using an atmospheric pressure applied downwardly from an upper portion of the drawing (face panel 200 side). Particularly, by fitting the lower end of the gap holding member 9 into the groove 13 formed in the control electrode 4, the positional displacement can be eliminated so that the gap holding member 9 can be accurately arranged.

Figure 14:
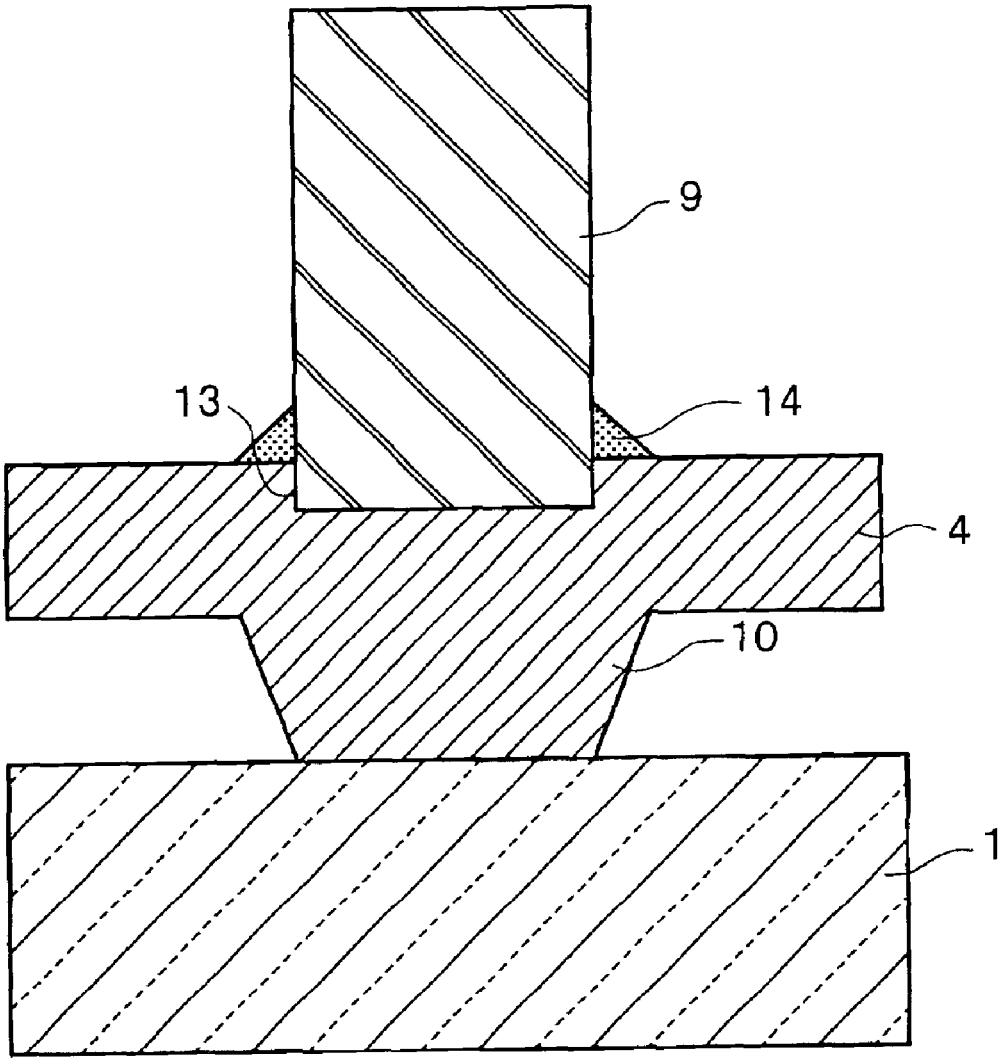
FIG. 14 is an explanatory view of another constitutional example of a portion of the display device according to the present invention which is surrounded by B in FIG. 2.

FIG. 14 is an explanatory view of another constitutional example of a portion surrounded by B in FIG. 2 of the display device according to the present invention. In this constitutional example, the gap holding member 9 is fixed by coating a first adhesive agent 14 to a periphery of a groove 13 of a control electrode 4. Due to such a constitution, the gap holding member 9 is further firmly fixed to the control electrode 4 and the displacement of the gap holding member 9 or the positional fluctuation of the control electrode 4 derived from an external impact such as vibration or the like can be obviated.

Figure 15:
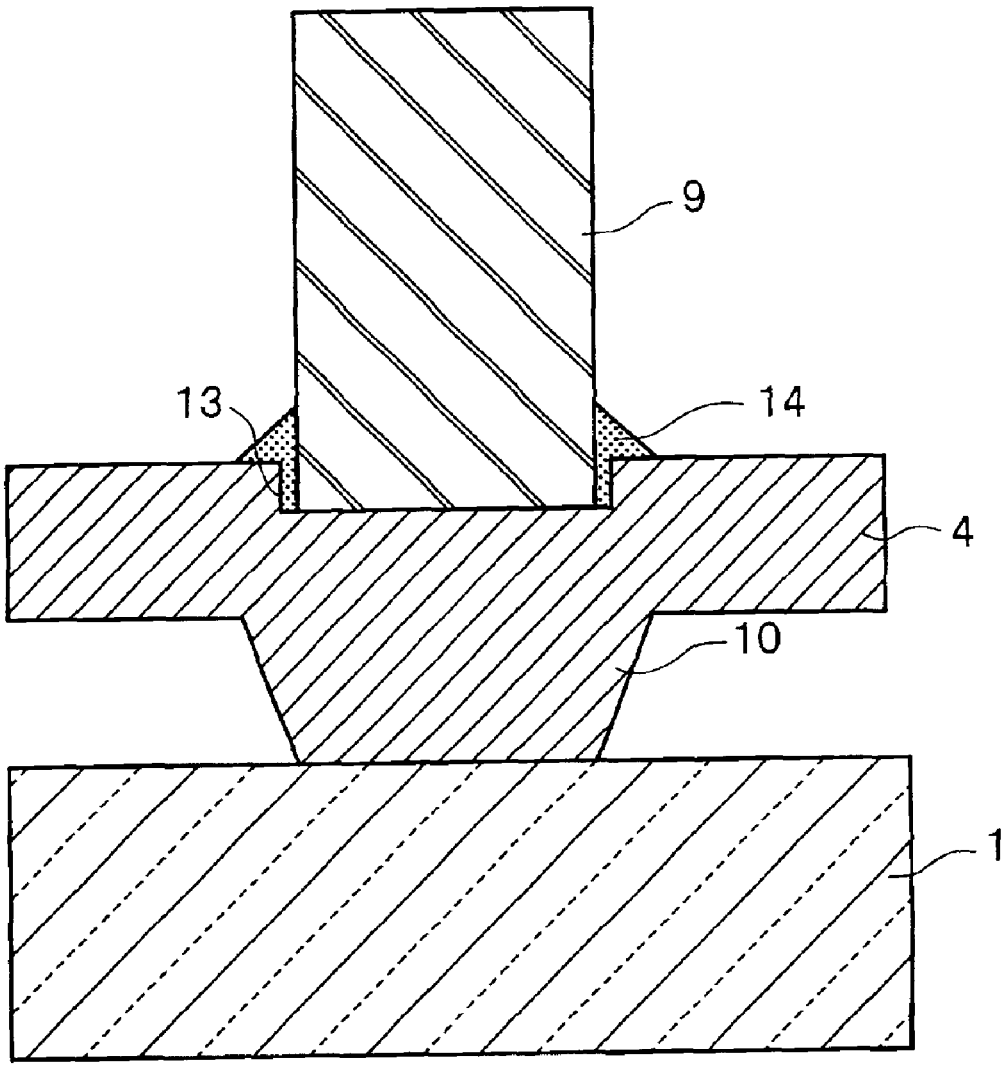
FIG. 15 is an explanatory view of another constitutional example of a portion of the display device according to the present invention which is surrounded by B in FIG. 2.

FIG. 15 is an explanatory view of another constitutional example of a portion surrounded by B of FIG. 2 of the display device of the present invention. In this constitutional example, a size of a groove 13 formed in the control electrode 4 is slightly made larger than a size of the gap holding member 9 and a first adhesive agent 14 is filled in side gaps formed between the gap holding member 9 and the groove 13. Due to such a constitution, the gap holding member 9 is further firmly fixed to the control electrode 4 so that the displacement of the gap holding member 9 or the positional fluctuation of the control electrode 4 derived from an external impact such as vibration or the like can be obviated.

Figure 16:
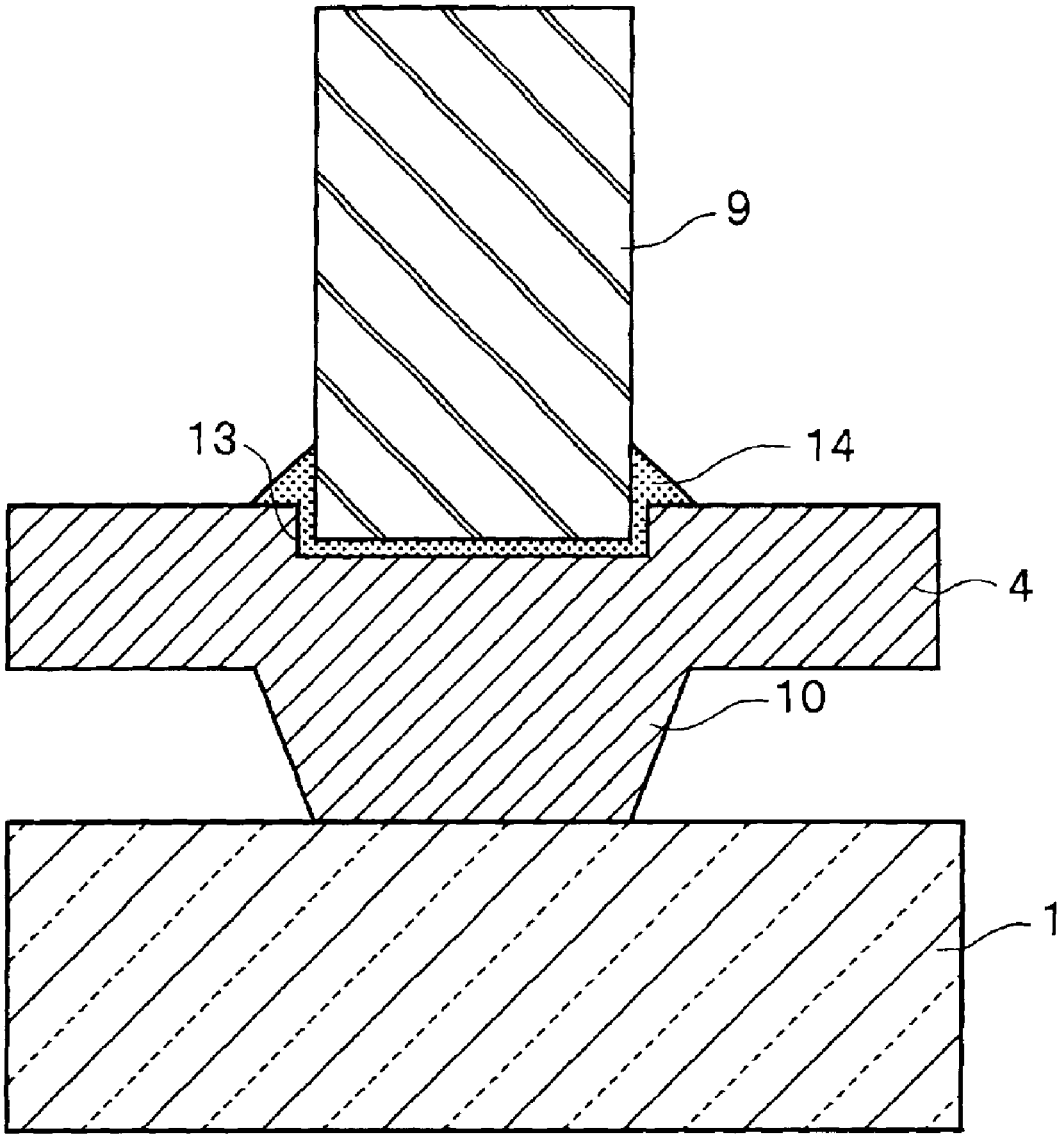
FIG. 16 is an explanatory view of another constitutional example of a portion of the display device according to the present invention which is surrounded by B in FIG. 2.

FIG. 16 is an explanatory view of another constitutional example of a portion surrounded by B in FIG. 2 of the display device according to the present invention. In this constitutional example, a size of a groove 13 formed in the control electrode 4 is slightly made larger than a size of the gap holding member 9 and a first adhesive agent 14 is filled in side gaps formed between the groove 13 and the gap holding member 9 and a gap formed between a bottom surface of the groove 13 and a lower end surface of the gap holding member 9. Due to such a constitution, the gap holding member 9 is further firmly fixed to the control electrode 4 so that the displacement of the gap holding member 9 or the positional fluctuation of the control electrode 4 derived from an external impact such as vibration or the like can be obviated.

Figure 17:
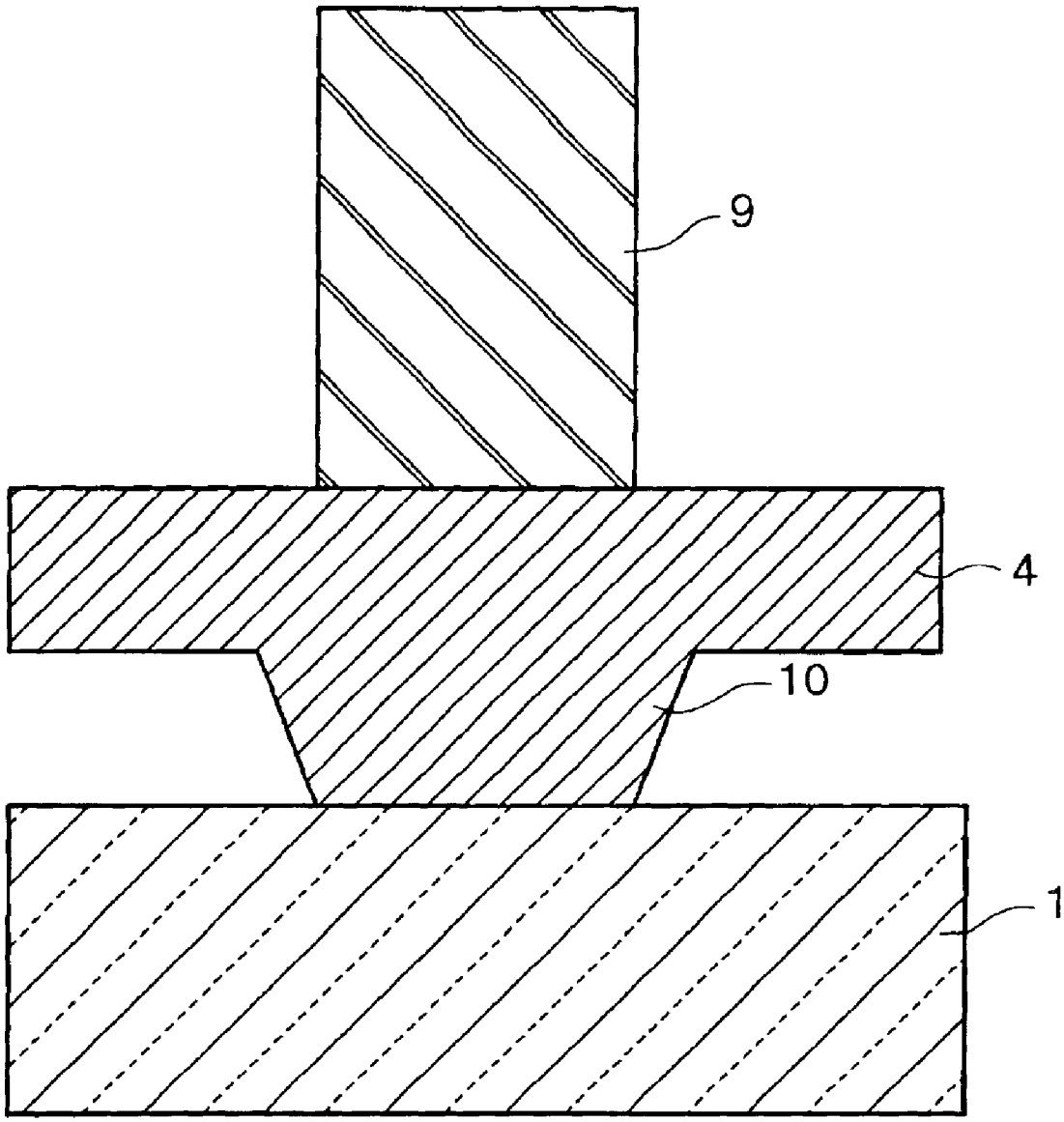
FIG. 17 is an explanatory view of another constitutional example of a portion of the display device according to the present invention which is surrounded by B in FIG. 2.

FIG. 17 is an explanatory view of another constitutional example of a portion surrounded by B in FIG. 2 of the display device according to the present invention. In this constitutional example, without forming a groove 13 in a control electrode 4, a gap holding member 9 is brought into contact with an upper surface of the control electrode 4. This structure facilitates the machining. Further, even when the control electrode 4 and the gap holding member 9 are subjected to the thermal deformation (thermal expansion or thermal shrinkage), strains do not affect contacting portions and hence, the constitutional example can strongly resist the thermal deformation.

Figure 18:
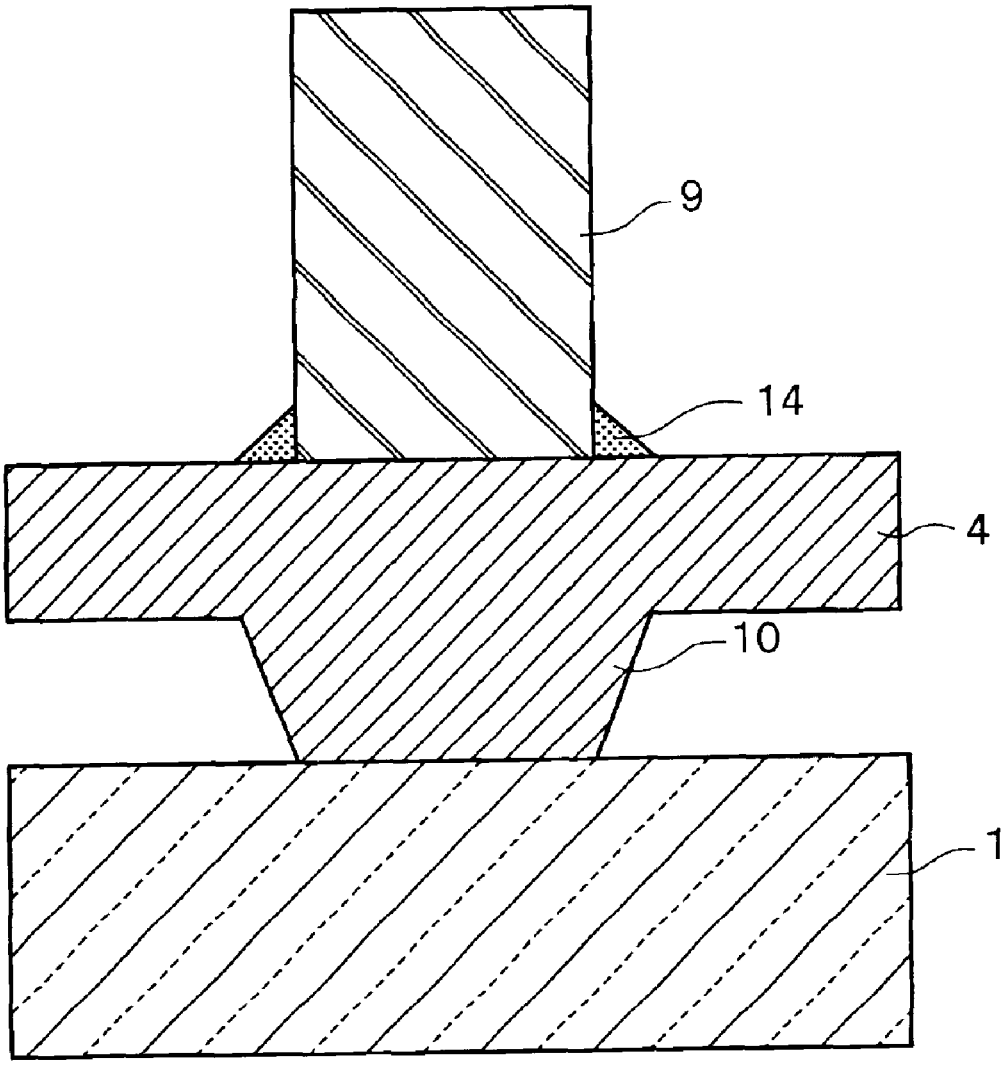
FIG. 18 is an explanatory view of another constitutional example of a portion of the display device according to the present invention which is surrounded by B in FIG. 2.

FIG. 18 is an explanatory view of another constitutional example of a portion surrounded by B in FIG. 2 of the display device according to the present invention. In this constitutional example, with respect to the constitution shown in FIG. 17, a gap holding member 9 is fixed to a control electrode 4 by coating a first adhesive agent 14 to a periphery of a contacting portion between the control electrode 4 and the gap holding member 9. Due to such a constitution, a fixing strength of the gap holding member 9 to the control electrode 4 can be increased compared to the constitution of FIG. 17.

Figure 19:
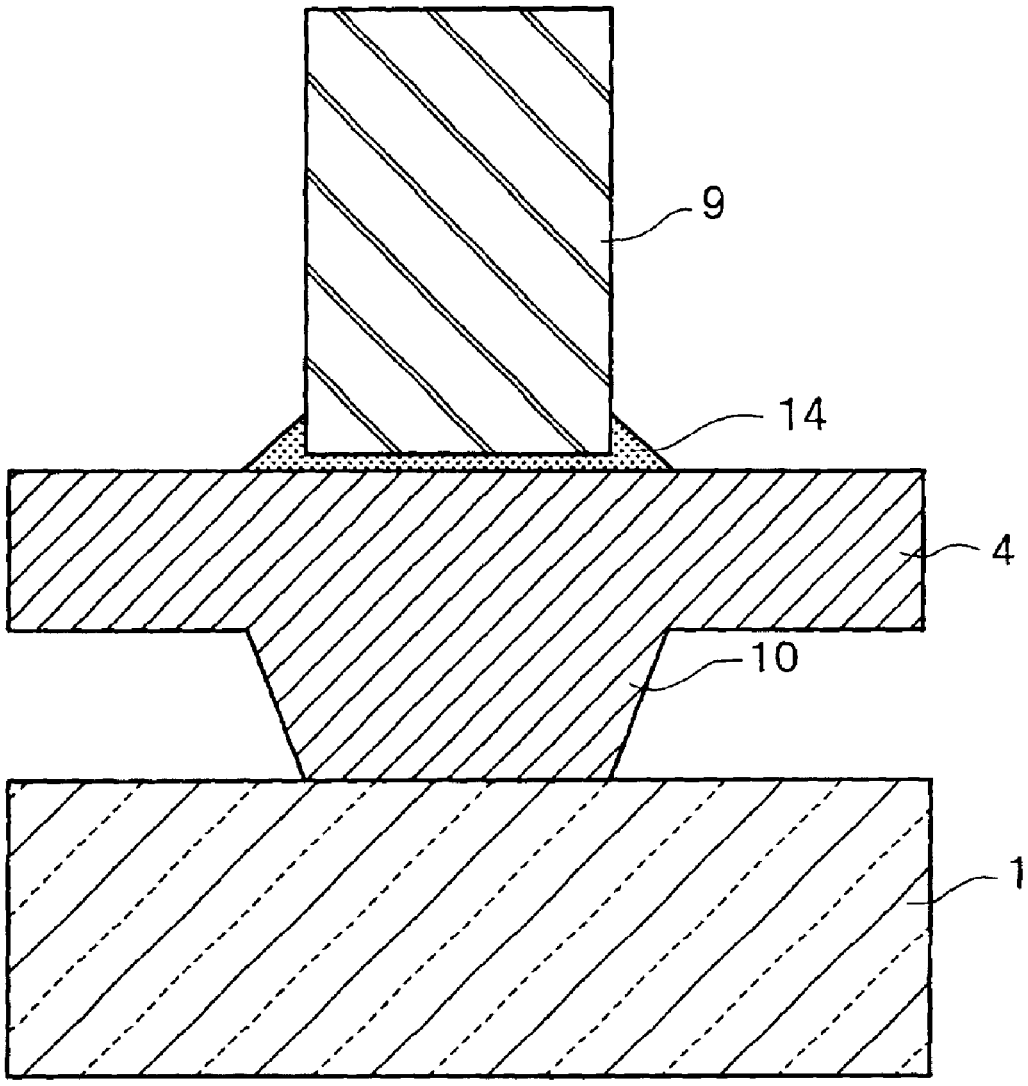
FIG. 19 is an explanatory view of another constitutional example of a portion of the display device according to the present invention which is surrounded by B in FIG. 2.

FIG. 19 is an explanatory view of another constitutional example of a portion surrounded by B in FIG. 2 of the display device according to the present invention. In this constitutional example, with respect to the constitution shown in FIG. 17, a first adhesive agent 14 is coated on and fixed to a periphery of a contacting portion between a control electrode 4 and a gap holding member 9 and a contacting surface between them. According to this constitution, the fixing strength of the control electrode 4 and the gap holding member 9 can be increased compared to the constitution of FIG. 17 and, at the same time, the irregularities of the surface condition of the control electrode 4 and the size of the gap holding member 9 can be absorbed by the adhesive agent so that the uniform gap can be obtained.

Figure 20:
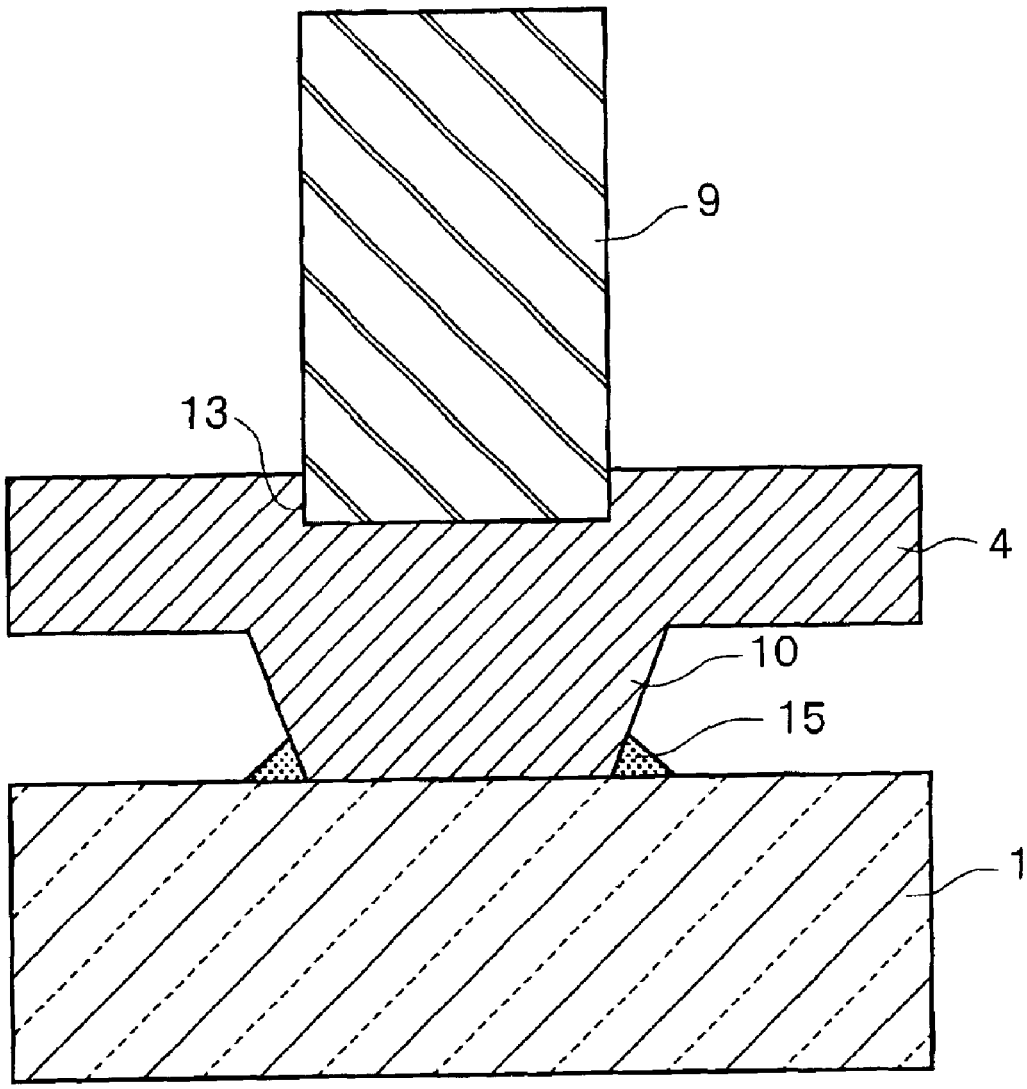
FIG. 20 is an explanatory view of another constitutional example of a portion of the display device according to the present invention which is surrounded by B in FIG. 2.

FIG. 20 is an explanatory view of another constitutional example of a portion surrounded by B in FIG. 2 of the display device according to the present invention. A control electrode 4 has a first contact portion 10 thereof brought into contact with a rear substrate 1 and a gap holding member 9 is arranged right above the first contact portion 10 of the control electrode 4. A groove 13 is formed in an upper surface of the control electrode 4 and the gap holding member 9 is fitted into the groove 13.

Then, the control electrode 4 and the rear substrate 1 are fixed to each other by means of a second adhesive agent 15. In this manner, the control electrode 4 and the rear substrate 1 are brought into direct contact with each other and are firmly fixed to each other by the adhesive agent 15 and hence, the rear substrate 1 and the control electrode 4 and eventually the gap holding member 9 are positioned with high precision and these positions can be held.

Figure 21:
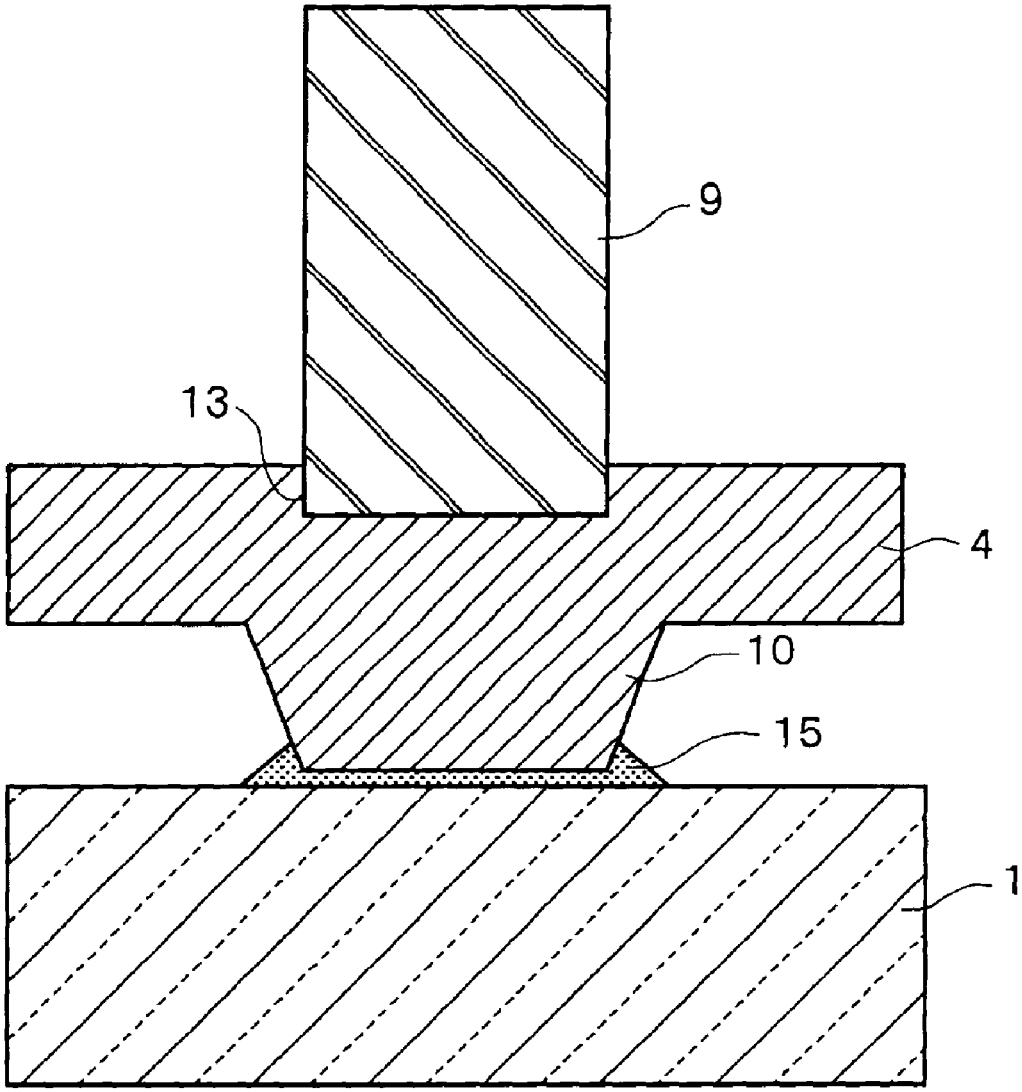
FIG. 21 is an explanatory view of still another constitutional example of a portion of the display device according to the present invention which is surrounded by B in FIG. 2.

FIG. 21 is an explanatory view of still another constitutional example of a portion surrounded by B in FIG. 2 of the display device according to the present invention. A control electrode 4 has a first contact portion 10 thereof fixed to a rear substrate 1 by means of a second adhesive agent 15 and a gap holding member 9 is arranged right above the first contact portion 10 of the control electrode 4. A groove 13 is formed in an upper surface of the control electrode 4 and the gap forming member 9 is fitted into the groove 13.

Then, the control electrode 4 and the rear substrate 1 are fixed to each other by means of the second adhesive agent 15. In this manner, the control electrode 4 is firmly fixed to the rear substrate 1 by the adhesive agent 15 which is infiltrated between the rear substrate 1 and the first contact portion 10 and hence, even when the irregularities exist with respect to the gap between the rear substrate 1 and a plurality of first contact portions 10, the adhesive agent can absorb the irregularities and hence, the rear substrate 1 and the control electrodes 4 and, eventually, the gap holding members 9 are positioned with high precision and these positions can be held.

Figure 22:
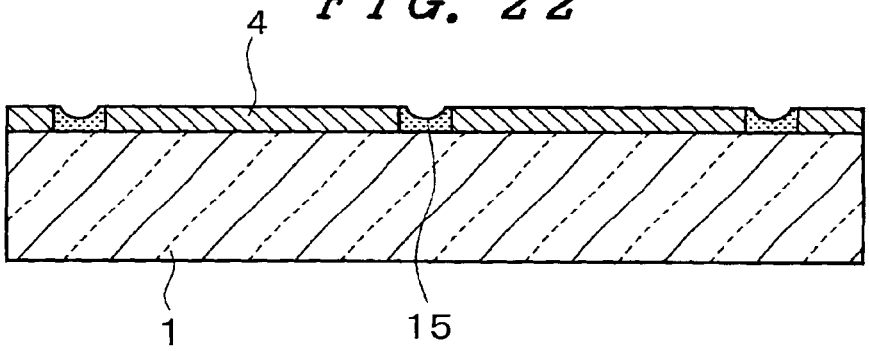
FIG. 22 is a cross-sectional view taken along a line I–J of FIG. 1 of the display device according to the present invention.

FIG. 22 is a cross-sectional view taken along a line I–J of FIG. 1 of the display device according to the present invention. A rear substrate 1 and a plurality of control electrodes 4 are fixed to each other by inserting a second adhesive agent 15 between them. Since the control electrodes 4 are directly fixed to the rear substrate 1, the positioning of the control electrodes 4 can be performed with high accuracy. Here, it is possible to combine the constitutions of the above-mentioned FIG. 13 to FIG. 22.

Subsequently, examples of other constitutions of gap holding members 9 are further explained. In the following explanation, since the constitutions of cathode wires 2 and control electrodes 4 mounted on a rear substrate 1 are similar to those of the above-mentioned embodiments, the repeated explanation is obviated unless otherwise specified.

Figure 23:
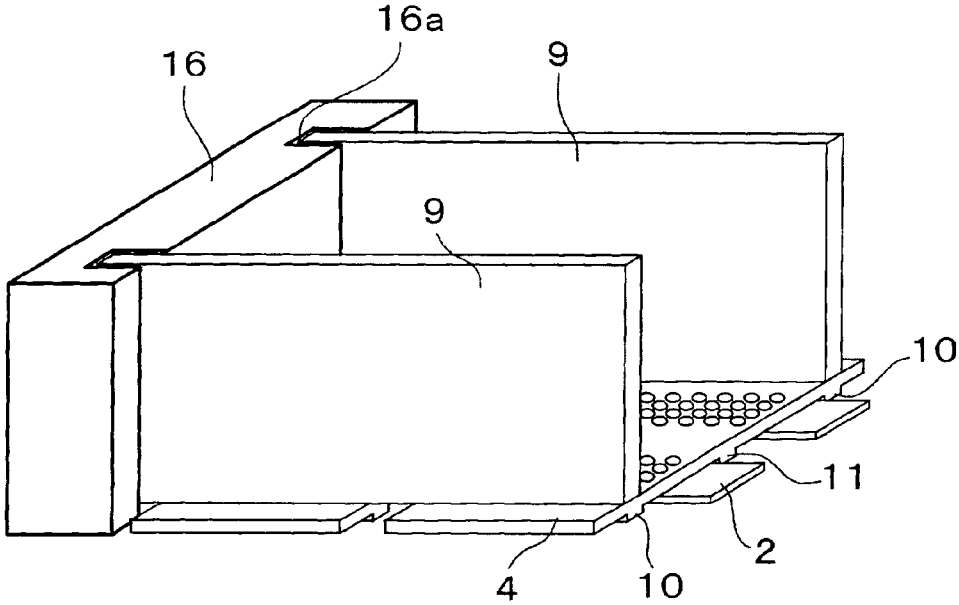
FIG. 23 is a perspective view showing a structure of a gap holding member for explaining a fourth embodiment according to the present invention.
Figure 24:
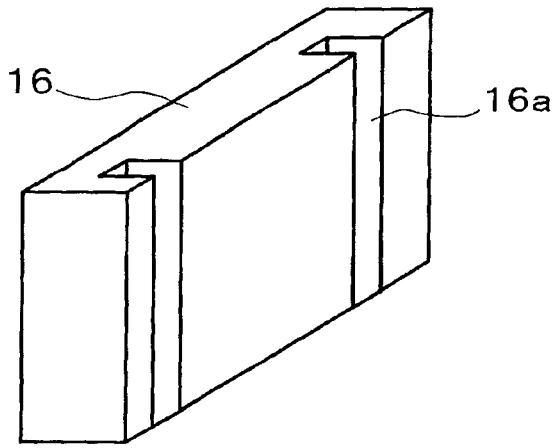
FIG. 24 is a perspective view of a supporting member shown in FIG. 23.

FIG. 23 is a perspective view showing the structure of gap holding members for explaining a fourth embodiment of the present invention. Further, FIG. 24 is a perspective view of a support member 16 shown in FIG. 23. In this embodiment, end portions of the gap holding members 9 are fixed by the support member 16. That is, the gap holding members 9 are supported with a given gap therebetween by the support member 16 which crosses the cathode wires 2.

As shown in FIG. 24, the support member 16 is provided with cuts 16*a* into which side peripheries of the gap holding members 9 extending in the gap holding direction are fitted. Such a constitution can restrict the positional relationship between the gap holding members 9 and can effectively resist an atmospheric pressure applied from both sides of a rear panel 100 and a face panel 200 and hence, a gap formed between the rear panel 100 and the face panel 200 can be restricted to a given value.

Further, by forming the cuts 16*a* into which the side peripheries of the gap holding members 9 extending in the gap holding direction are fitted in the support member 16 and by fitting the gap holding members 9 into the cuts 16*a*, the positional relationship between the gap holding members 9 can be set with accuracy.

Figure 25:
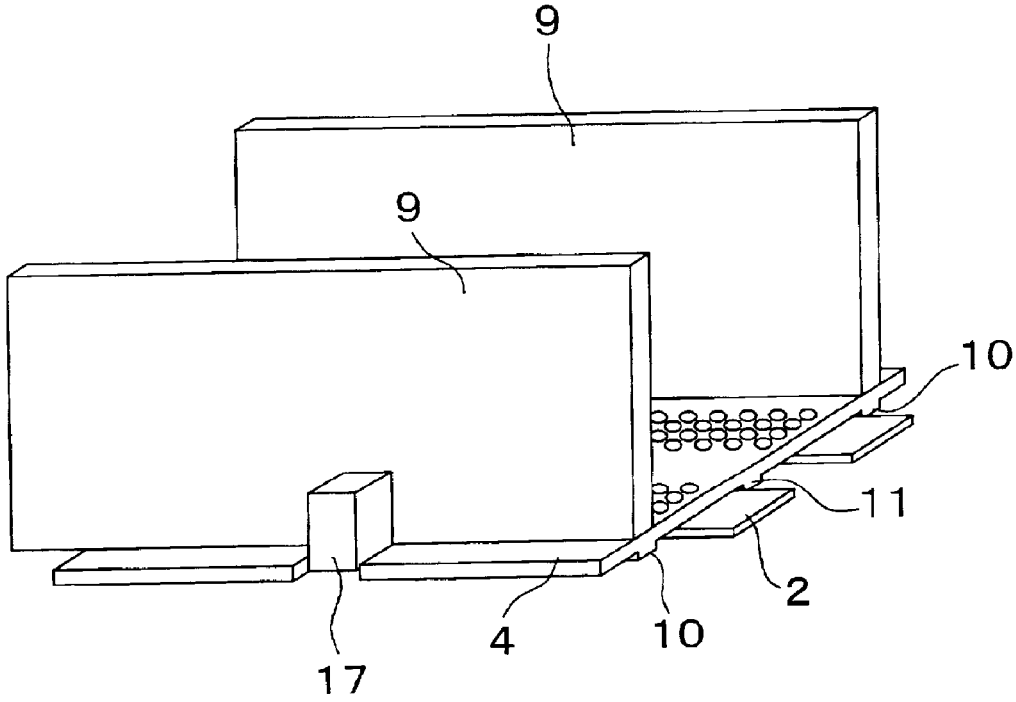
FIG. 25 is a perspective view showing a structure of a gap holding member for explaining a fifth embodiment according to the present invention.
Figure 26:
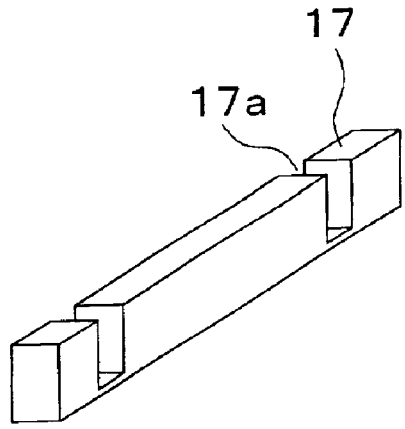
FIG. 26 is a perspective view of an auxiliary supporting member shown in FIG. 25.

FIG. 25 is a perspective view showing a structure of gap holding members for explaining a fifth embodiment according to the present invention. Further, FIG. 26 is a perspective view of an auxiliary support member 17 shown in FIG. 25. In this embodiment, the auxiliary support member 17 is arranged between neighboring control electrodes 4 and at a position where the auxiliary support member 17 crosses the gap holding members 9. The auxiliary support member 17 has cuts 17*a* into which end peripheries of the gap holding members 9 at the cathode wire 2 side are fitted.

Further, by fitting lower ends of the gap holding members 9 into the cuts 17*a,* the positional relationship between the gap holding members 9 is determined and the gap holding members 9 are supported with a given gap therebetween by the auxiliary support member 17 which intersects the cathode wires 2.

Such a constitution can restrict the positional relationship between the gap holding members 9 and can effectively resist an atmospheric pressure applied from both sides of a rear panel 100 and a face panel 200 and hence, a gap formed between the rear panel 100 and the face panel 200 can be set to a given value.

The auxiliary support member 17 can be mounted not only on the periphery of a display device but also in the inside of a display region. Accordingly, by efficiently arranging the gap holding members 9 over the whole display device, the gap can be set more effectively.

Further, the support member 16 or the auxiliary support member 17 in the above-mentioned fourth embodiment and fifth embodiment can be made of inorganic material, metal having an insulation treatment on a surface thereof, glass, quartz or the like. Further, mica has the heat resistance, can be machined easily and has the resiliency and hence, mica can be also used as the material of the support member 16 or the auxiliary support member 17. Further, the cut portions 16*a,* 17*a* of the support member 16 or the auxiliary support member 17 can be also fixed using a proper adhesive agent.

Figure 27:
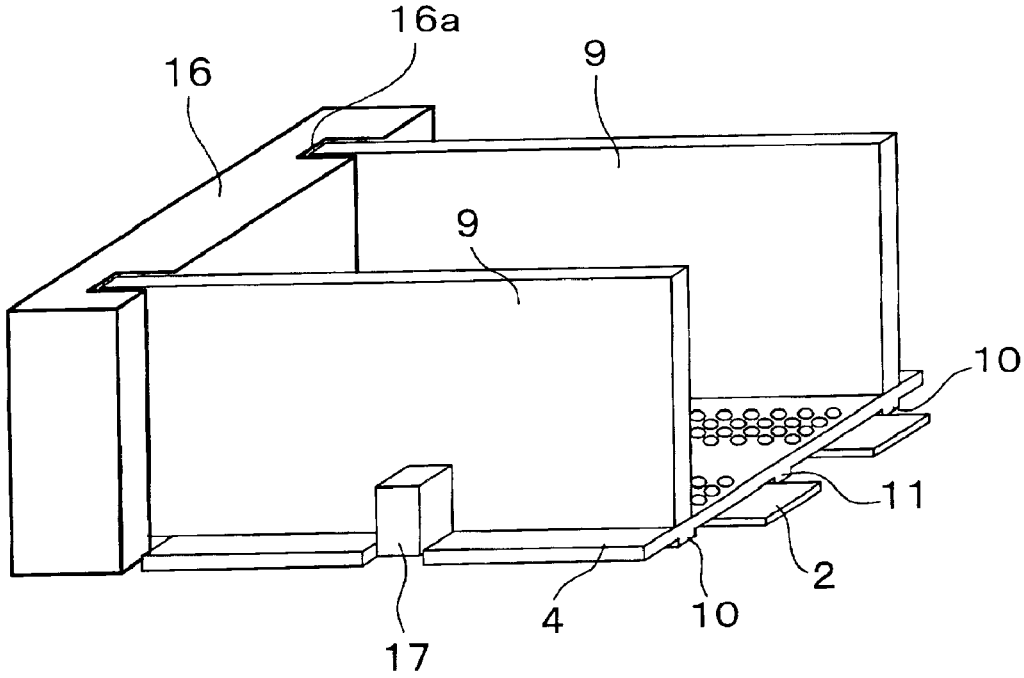
FIG. 27 is a perspective view showing a structure of a gap holding member for explaining a sixth embodiment according to the present invention.

FIG. 27 is a perspective view showing the structure of gap holding members for explaining a sixth embodiment of the present invention. The embodiment show a combination of the above-mentioned structure in FIG. 23 and FIG. 24 and the structure in FIG. 25 and FIG. 26. Due to such a constitution, the gap holding members 9 can be fixed over the whole display device accurately and surely.

Figure 28:
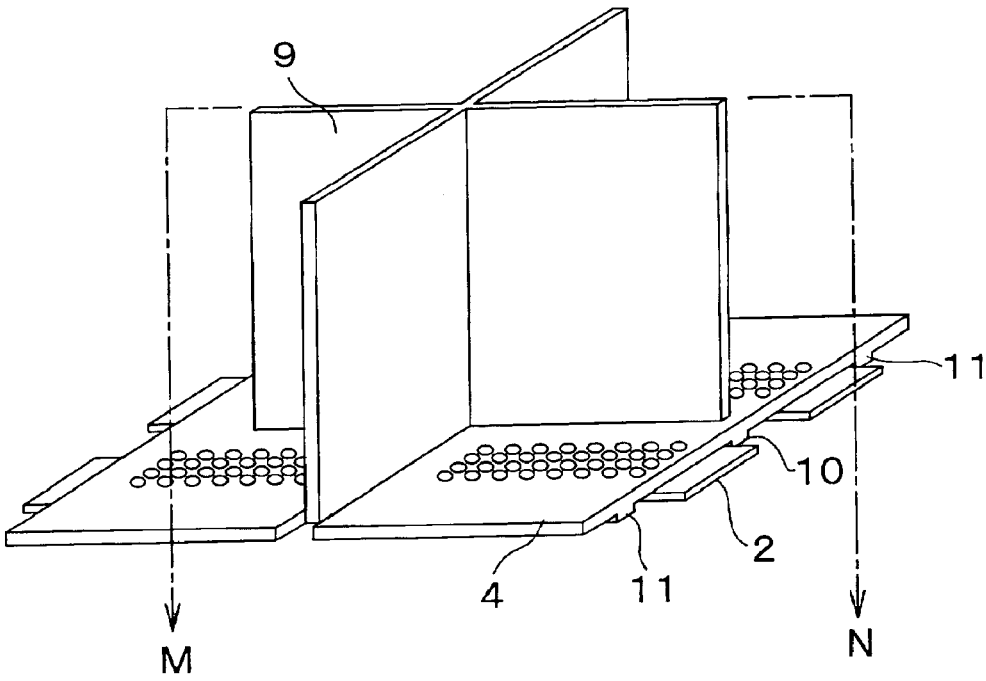
FIG. 28 is a perspective view showing a structure of a gap holding member for explaining a seventh embodiment according to the present invention.
Figure 29:
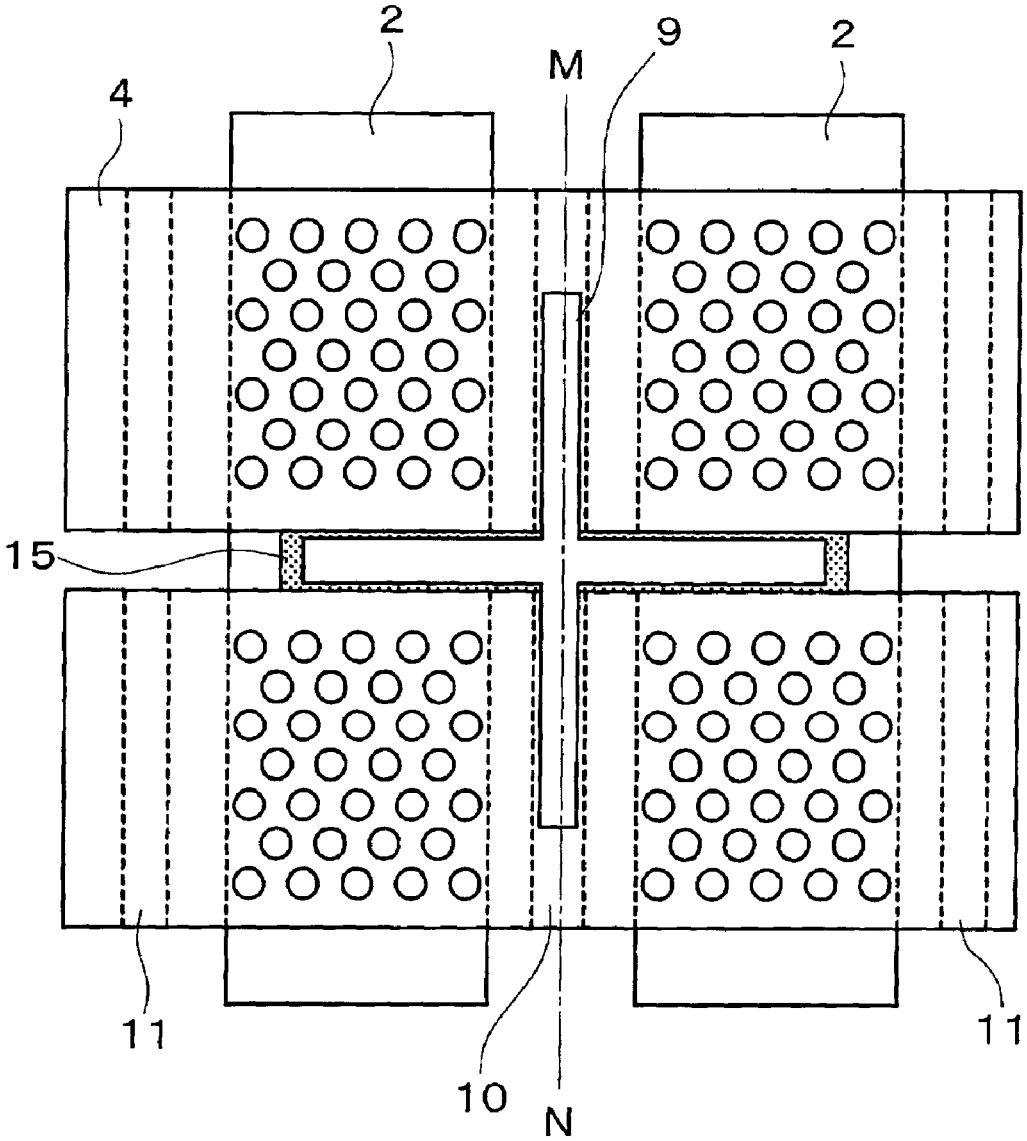
FIG. 29 is a top plan view of FIG. 28.
Figure 30:
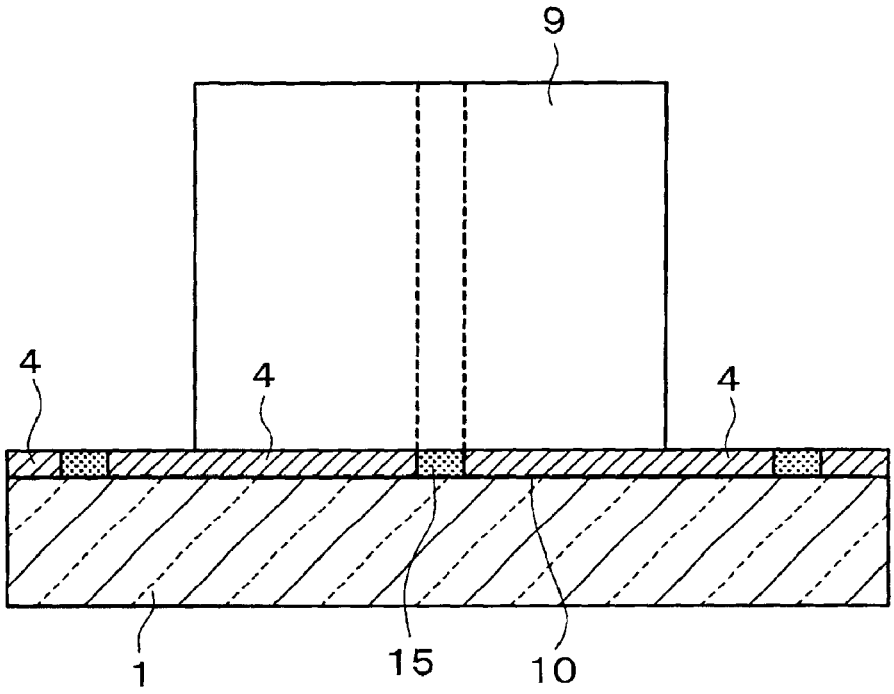
FIG. 30 is a cross-sectional view taken along a line M–N of FIG. 29.

FIG. 28 is a perspective view showing the structure of gap holding members for explaining a seventh embodiment of the present invention. Further, FIG. 29 is a top plan view of FIG. 28 and FIG. 30 is a cross-sectional view taken along a line M–N of FIG. 29. The gap holding member 9 of this embodiment has an approximately cruciform cross section having a cross structure formed of plate-like members which are respectively arranged in parallel to cathode wires 2 and control electrodes 4 among neighboring pixel regions.

In this embodiment, out of two plate-like members having the cross structure of the gap holding member 9, one plate-like member is arranged between the control electrodes 4 and the other is arranged right above the first contact portions 10 of the control electrodes 4.

The gap holding member 9 having such a shape per se has a self-standing function with respect to a surface of a substrate and the gap defined between a face panel 200 and a rear panel 100 can be held at a predetermined value by mounting the gap holding member 9 at the given portion among the pixel regions.

Between the plate-like member of the gap holding member 9 which intersects the cathode wires 2 and the rear substrate 1 and the cathode wires 2, a second adhesive agent 15 is filled. By fixing the gap holding members 9 using such a second adhesive agent 15, the gap holding members 9 can be surely mounted on the rear substrate 1 in an erected manner and the gap defined between the face panel 200 and the rear panel 100 can be also held at a predetermined value.

Figure 31:
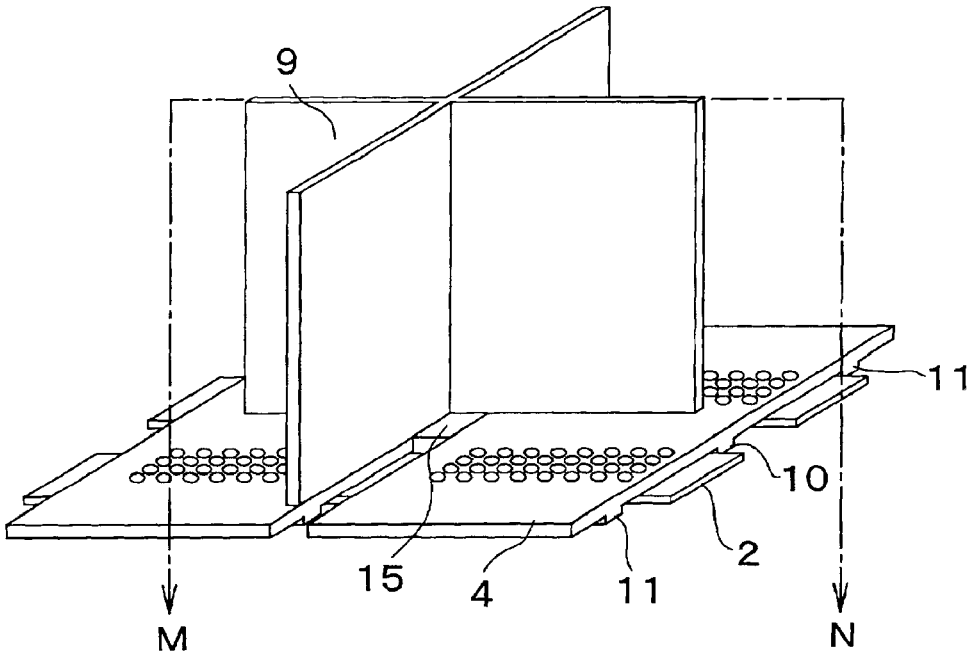
FIG. 31 is a perspective view showing a structure of a gap holding member for explaining an eighth embodiment according to the present invention.
Figure 32:
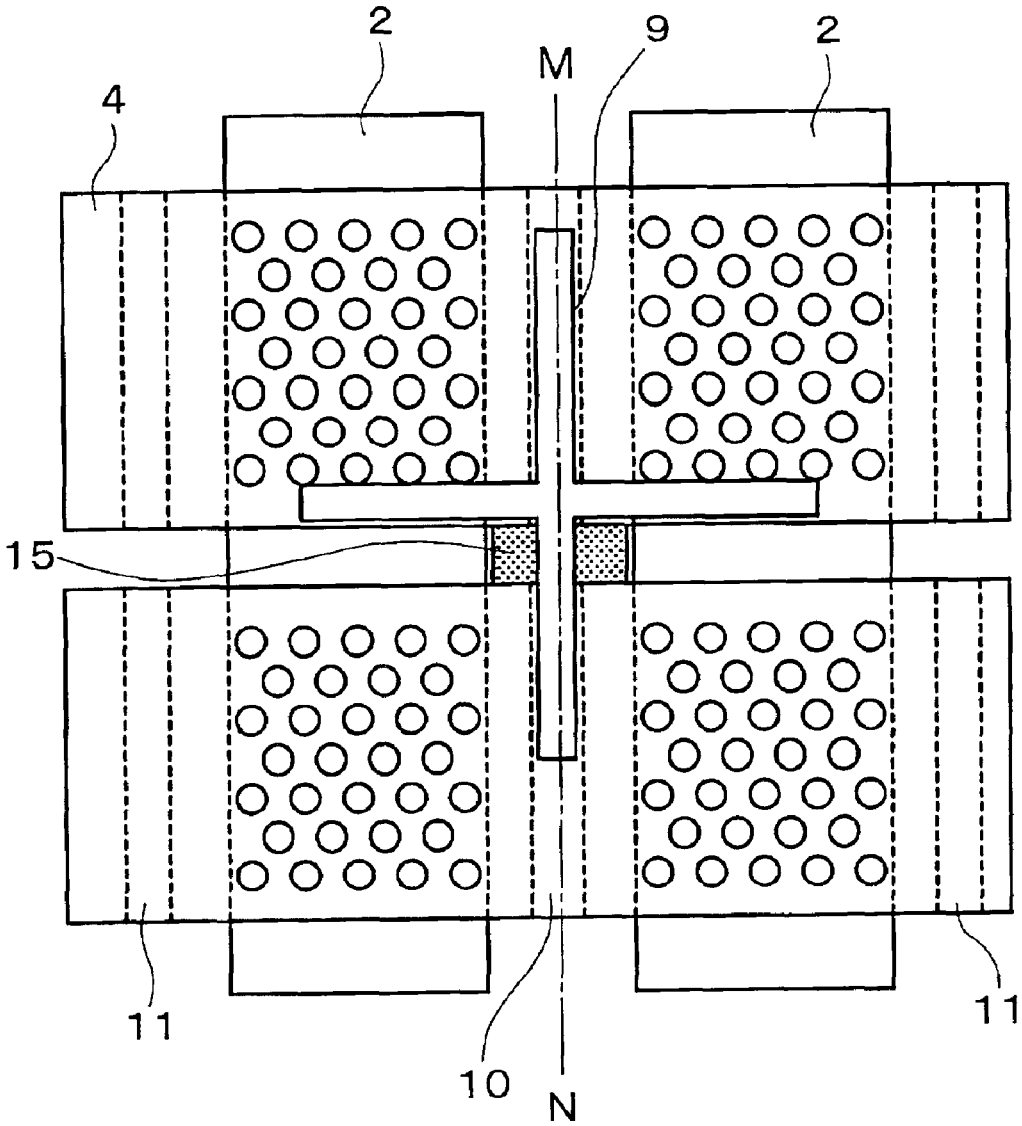
FIG. 32 is a top plan view of FIG. 31.
Figure 33:
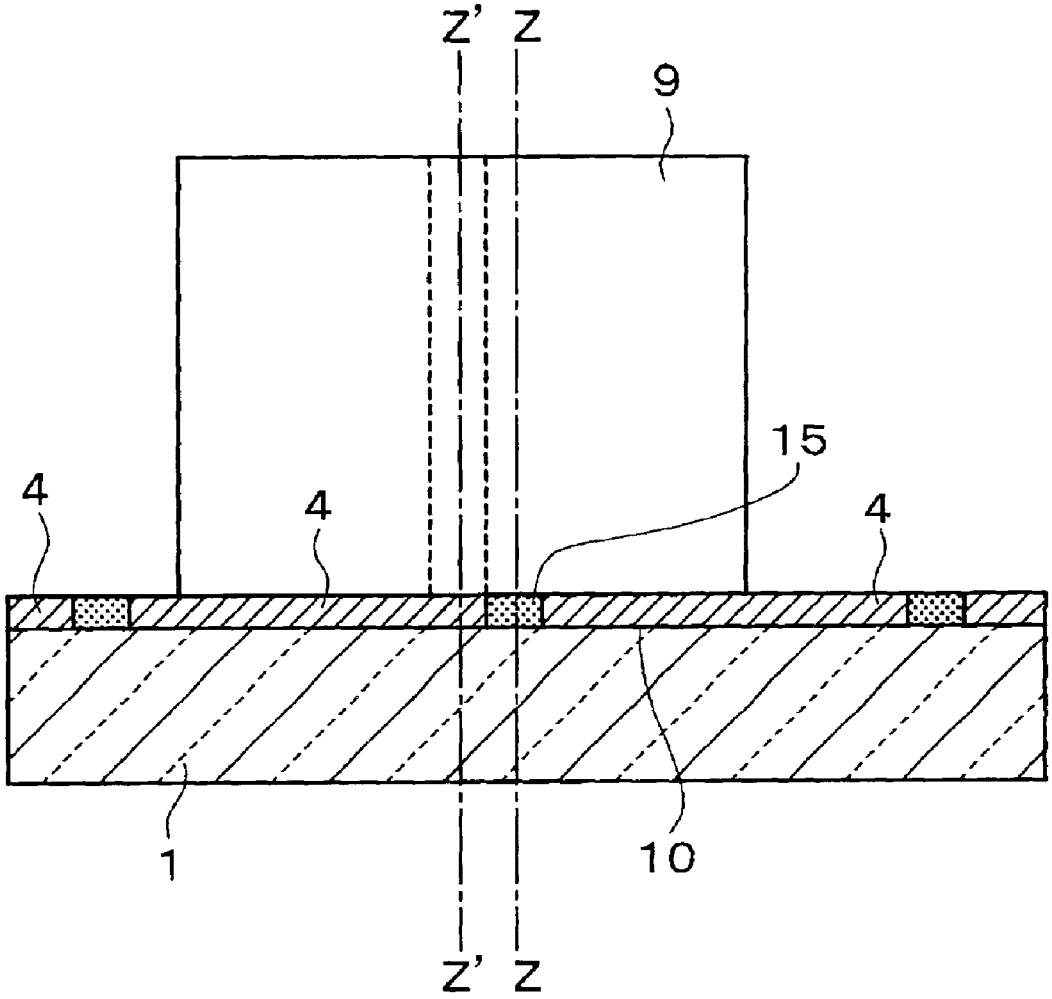
FIG. 33 is a cross-sectional view taken along a line M–N of FIG. 32.

FIG. 31 is a perspective view showing a structure of a gap holding member for explaining an eighth embodiment according to the present invention. Further, FIG. 32 is a top plan view of FIG. 31 and FIG. 33 is a cross-sectional view taken along a line M–N of FIG. 32. The gap holding member 9 of this embodiment has, in the same manner as the seventh embodiment, an approximately cruciform cross section having a cross structure formed of plate-like members which are arranged in parallel to cathode wires 2 and control electrodes 4 respectively among neighboring pixel regions.

Then, all plate-like members of the gap holding member 9 which cross cathode wires 2 are positioned above the control electrodes 4. As shown in FIG. 33, a center line Z'—Z' of the gap holding member 9 having the cross structure of this embodiment assumes a position which is displaced with respect to a vertical line Z—Z which passes the center of the neighboring pixels. Since an lower end of the gap holding member 9 is positioned above the control electrodes 4, the mounting position in an erected posture can be accurately determined.

Further, between the plate-like member of the gap holding member 9 which are arranged parallel to the cathode wires 2 and the rear substrate 1, a second adhesive agent 15 is filled. By fixing the gap holding members 9 using such a second adhesive agent 15, the gap holding members 9 can be mounted on the rear substrate 1 surely and in a reliable manner.

Figure 34A:
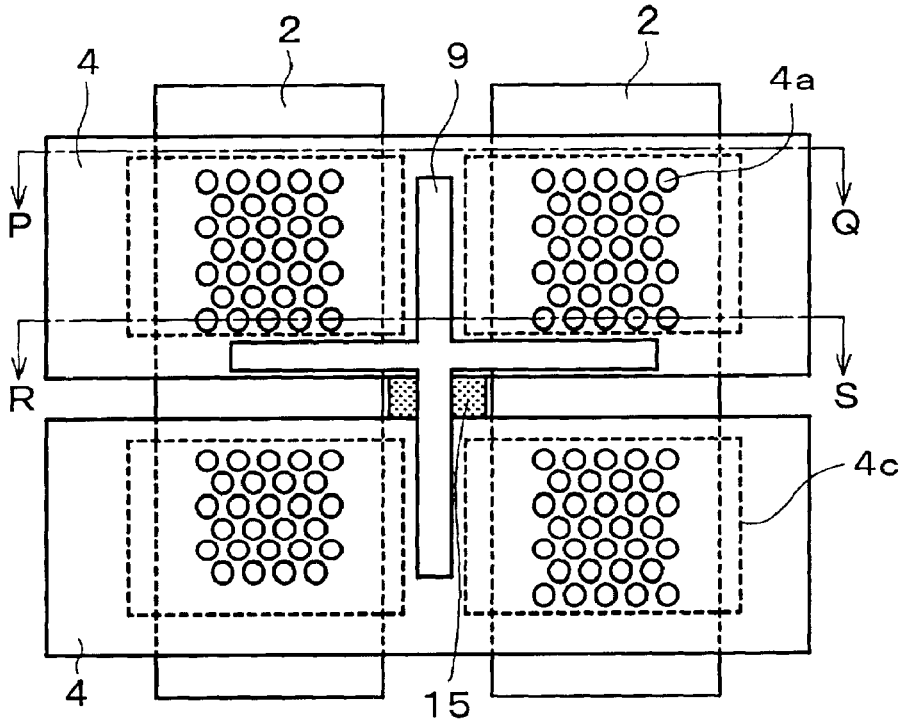
Figure 34B:
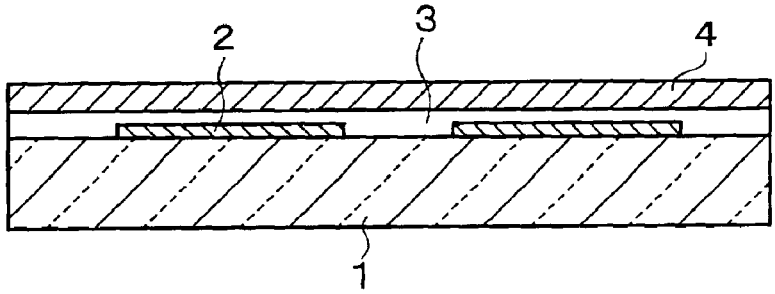
Figure 34C:
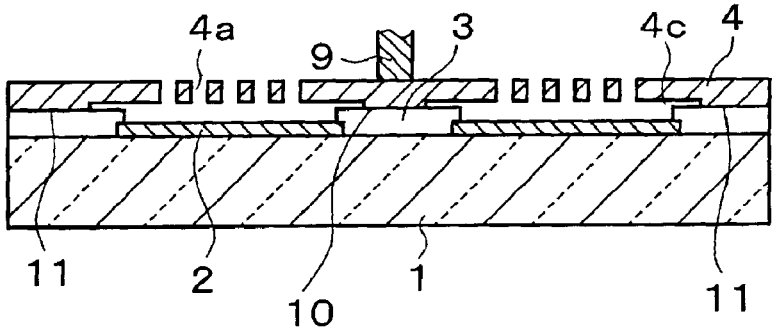

FIG. 34A to FIG. 34C are structural views of a gap holding member and a rear panel for explaining a ninth embodiment according to the present invention, wherein FIG. 34A is a plan view, FIG. 34B is a cross-sectional view taken along a line P–Q of FIG. 34A and FIG. 34C is a cross-sectional view taken along a line R–S of FIG. 34A. The gap holding member 9 of this embodiment has a constitution similar to that of the gap holding member 9 of the eighth embodiment.

Each control electrode 4 has recessed portions 4*c* in a cathode wire 2 side including a pixel region which forms holes 4*a* therein, wherein the recessed portions 4*c* form a gap between the holes 4*a* and cathode wires 2. The recessed portions 4*c* are formed such that the recessed portions 4*c* are extended over the width of the cathode wires 2. The gap between the holes 4*a* of the control electrodes 4 and the cathode wires 2 can be adjusted based on a depth of the recessed portions 4*c* so that the gap can be determined more accurately.

In this embodiment, since the recessed portions 4*c* are formed smaller than the width of the control electrode 4, the control electrode 4 has projecting portions also at peripheral portions thereof along the extending direction of the control electrode 4. Further, an insulation layer 3 is formed between the projecting portions and the cathode wires 2. Although capacitance is generated due to the insulation layer 3, such a region is small so that the high frequency driving is possible. Here, insulation layers 3 are also formed between a first contact portion 10 of the control electrode 4 and a rear substrate 1 as well as between a second contact portion 11 and the rear substrate 1.

It is preferable to fix the control electrode 4 in the state that a tension is applied to the control electrode 4 in a longitudinal direction. At the time of assembling the control electrode 4 to the substrate 1 of the rear panel, end portions of the control electrode 4 are fixed to the substrate 1 using an adhesive agent while applying the tension to the control electrode 4 in the longitudinal direction of the control electrode 4. Due to such a constitution, the flatness of the control electrode 4 is guaranteed so that a gap defined between the holes 4*a* and the cathode wires 2 can be set uniform. The same goes for other embodiments.

Figure 35A:
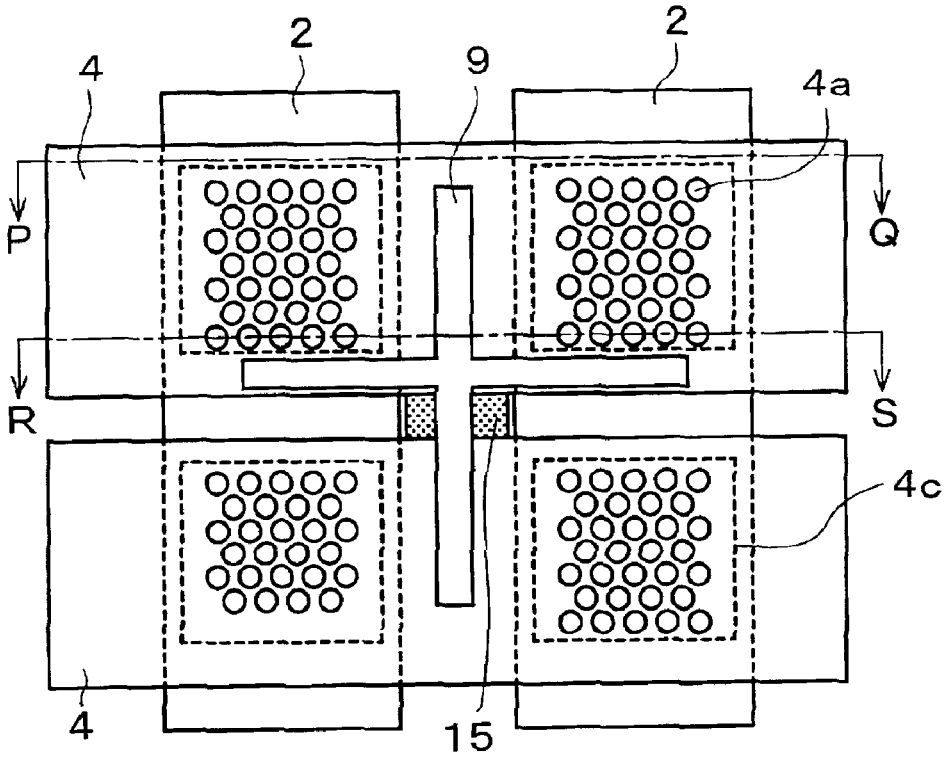
Figure 35B:
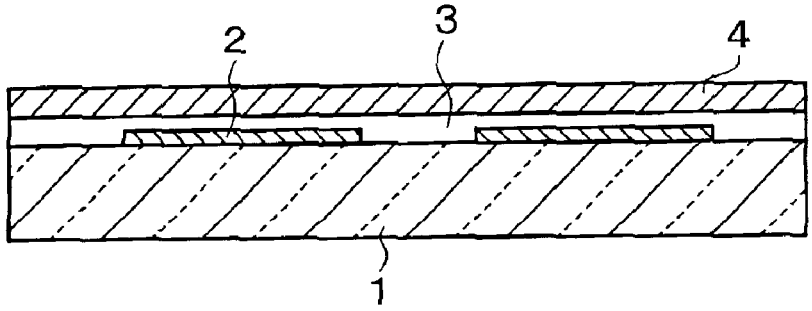
Figure 35C:
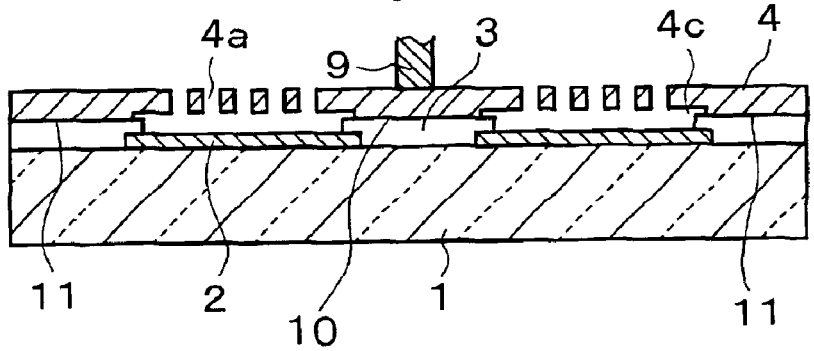

FIG. 35A to FIG. 35C are structural views of a gap holding member and a rear panel for explaining a tenth embodiment according to the present invention, wherein FIG. 35A is a plan view, FIG. 35B is a cross-sectional view taken along a line P–Q of FIG. 35A and FIG. 35C is a cross-sectional view taken along a line R–S of FIG. 35A. This embodiment is a modification of the ninth embodiment. Although the control electrode 4 has the structure similar to that of the ninth embodiment, in this embodiment, a range of each recessed portion 4*c* formed in the control electrode 4 is arranged to fall within a region in which the control electrode 4 crosses the cathode wire 2.

The recessed portions 4*c* which have been explained in conjunction with the ninth embodiment and the tenth embodiment may be combined with the constitutions of other embodiments.

Figure 36A:
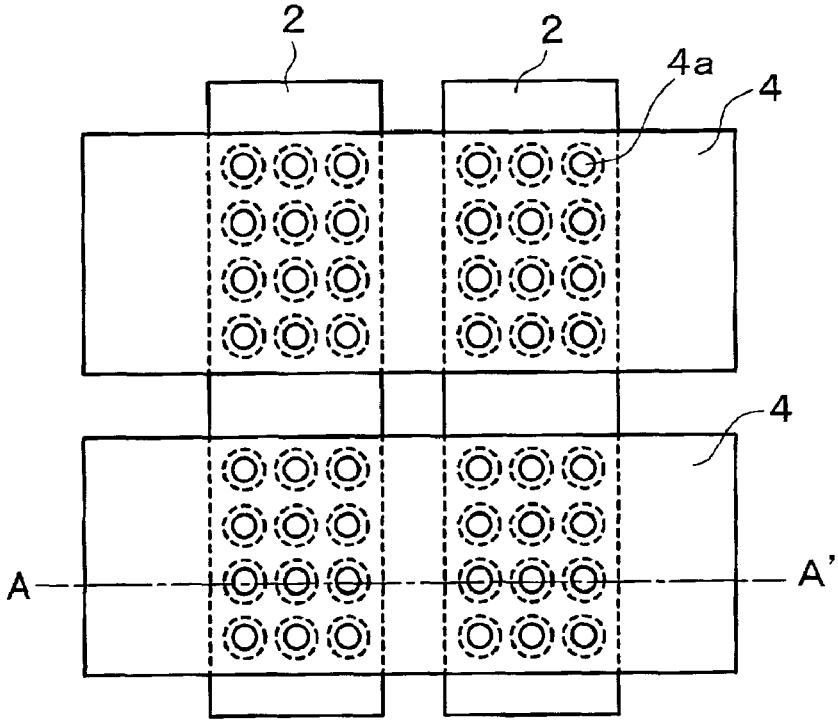
Figure 36B:
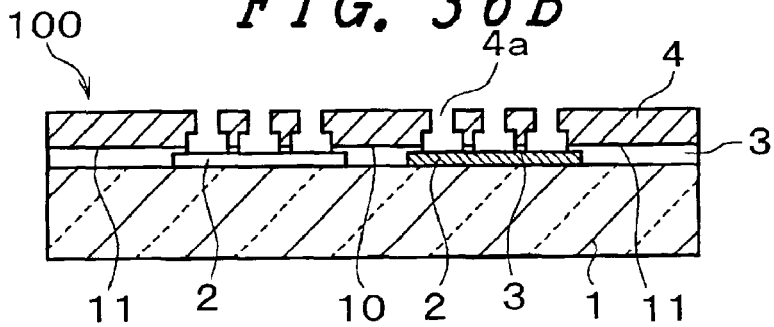
Figure 36C:
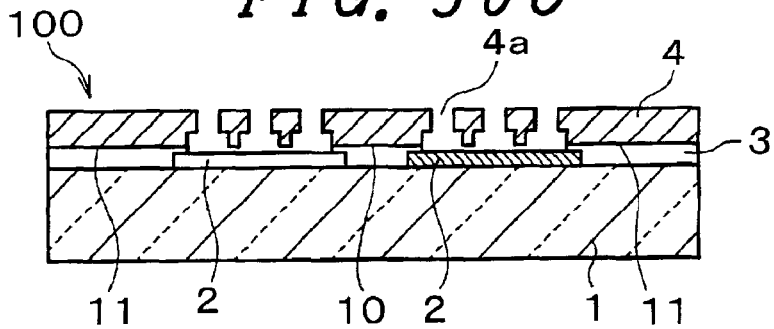

FIG. 36A to FIG. 36C are structural views around control electrodes for explaining an eleventh embodiment according to the present invention, wherein FIG. 36A is a plan view and FIG. 36B and FIG. 36C are cross-sectional views taken along a line A–A' of FIG. 36A. Each hole 4*a* formed in a control electrode 4 of this embodiment has a stepped shape formed in two stages and has a large-diameter at a cathode-wire 2 side and a small diameter at an anode 7 side. A gap defined between the cathode wire 2 and the hole 4*a* depends on a machining depth at the large diameter side.

As shown in FIG. 36B, an insulation layer 3 may be interposed at a cathode-wire 2 side in a region defined between the apertures 4*a,* while, as shown in FIG. 36C, a space may be formed with respect to the cathode wires 2. With respect to the structure shown in FIG. 36B, although the control electrodes 4 and the cathode wires 2 can be accurately insulated from each other, with the provision of the structure shown in FIG. 36C, the capacitance can be reduced and the display device suitable for high frequency driving can be obtained.

The ninth embodiment, the tenth embodiment and the eleventh embodiment which have been explained above may be selected depending on the strength and size of the plate-like bodies of the control electrodes 4 and the screen size of the display device. Further, with respect to the gap holding member 9, any gap holding member of any one of the above-mentioned embodiments can be adopted.

Here, the illustration of the gap holding member 9 is omitted from FIG. 36A to FIG. 36C.

By setting the thermal expansion coefficient of the control electrodes 4 to a value larger than the thermal expansion coefficient of the rear substrate 1, in conveying the control electrodes 4 through a heating process (for example, process in which the control electrodes 4 are heated at a temperature of equal to or more than 300 degrees centigrade) in a fabrication process, the control electrodes 4 are fixed to the rear substrate 1 at a temperature higher than a room temperature and, thereafter, the control electrodes 4 are cooled down to a room temperature so that a tensile stress is generated in the control electrodes 4. Accordingly, the control electrodes 4 can always hold the flatness and can hold the gap between the control electrodes 4 and the cathode wires 2 with high accuracy.

Figure 37:
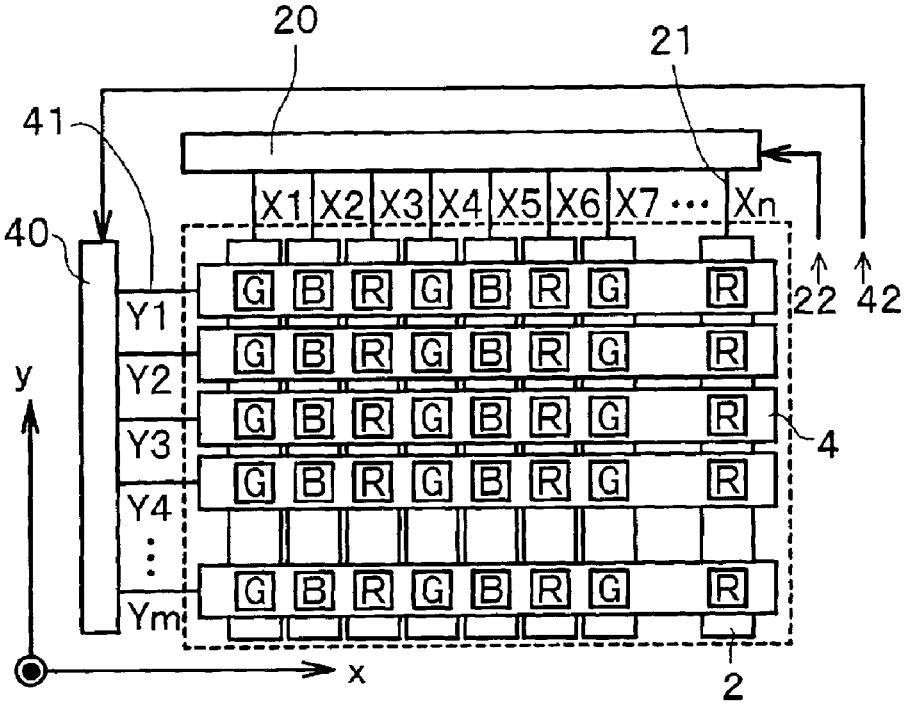
FIG. 37 is an equivalent circuit for explaining a driving method of the display device according to the present invention.
Figure 38:
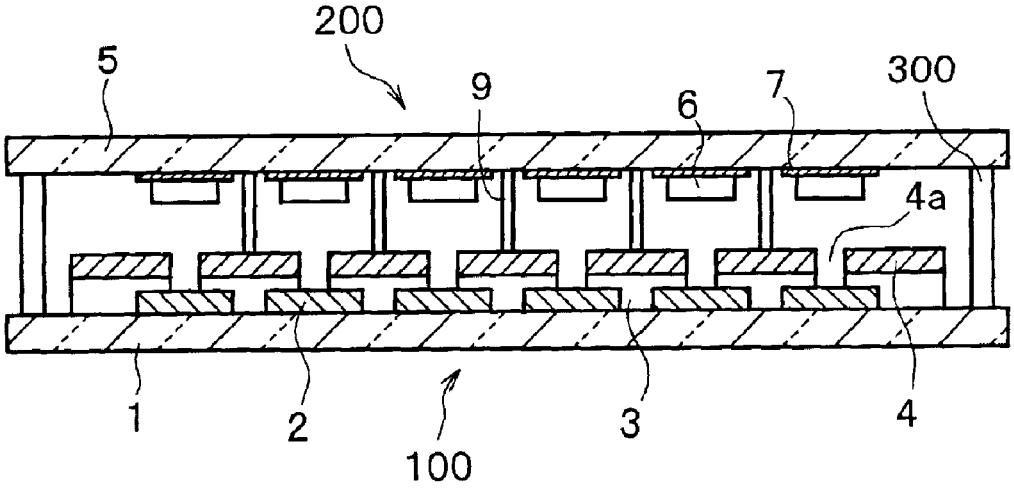
FIG. 38 PRIOR ART
FIG. 38 is a cross-sectional view for explaining one constitutional example of a field emission type display device.
Figure 39A:
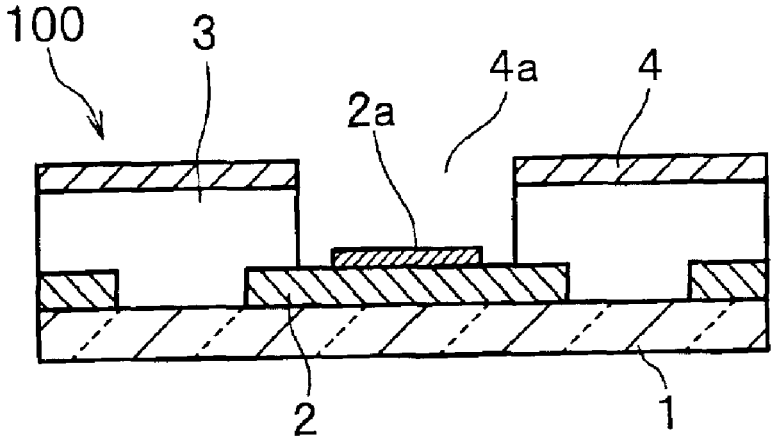
FIG. 39A PRIOR ART
Figure 39B:
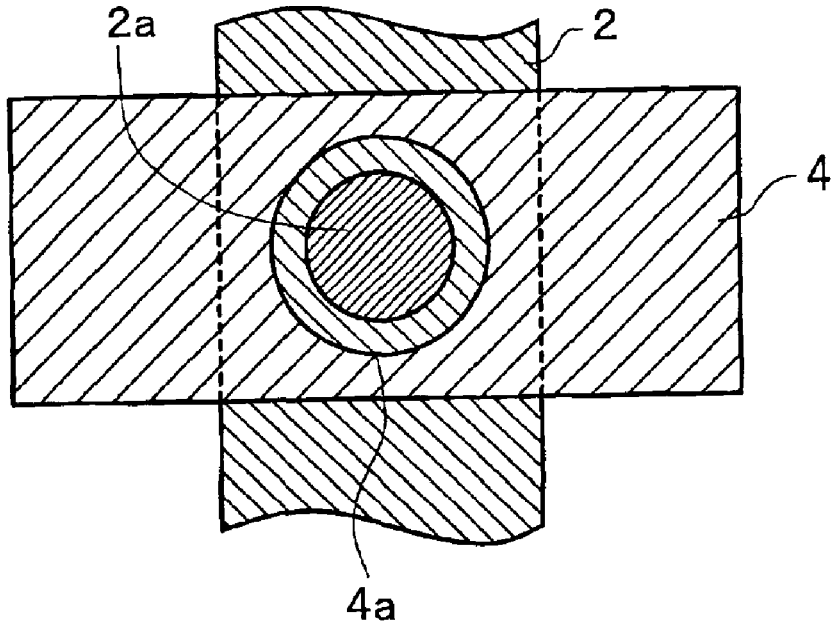
FIG. 39B PRIOR ART
Figure 40A:
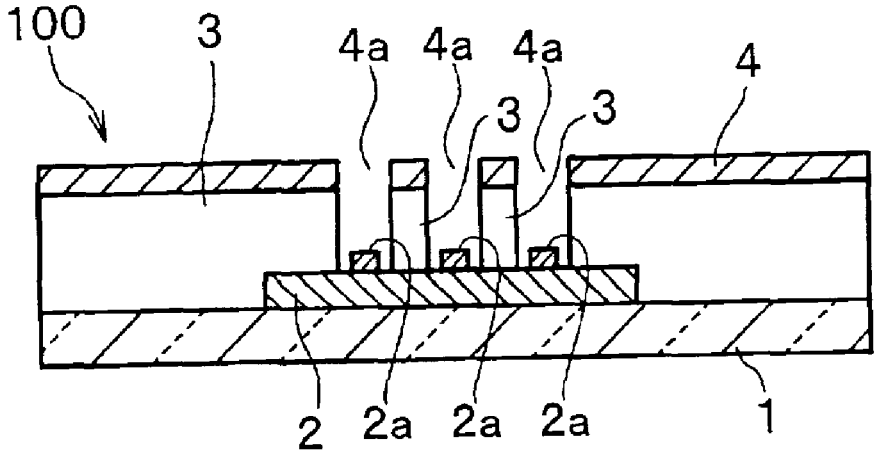
FIG. 40A PRIOR ART
FIG. 40A and FIG. 40B are explanatory views corresponding to FIG. 39A and FIG. 39B of a display device which forms a plurality of electron emitting sources per one pixel.
Figure 40B:
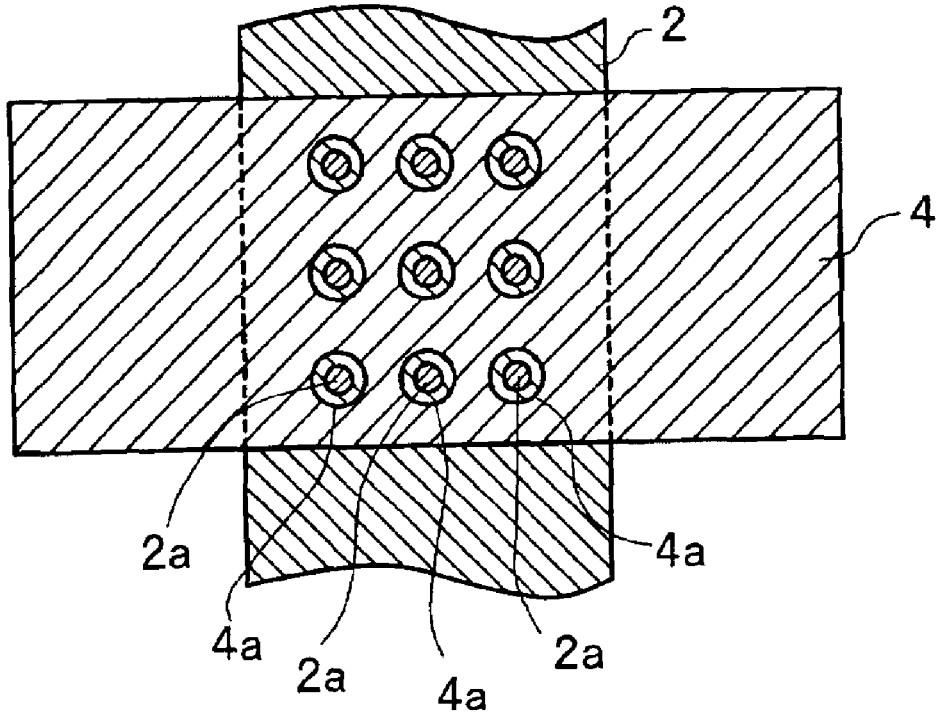
FIG. 40B PRIOR ART
Figure 41:
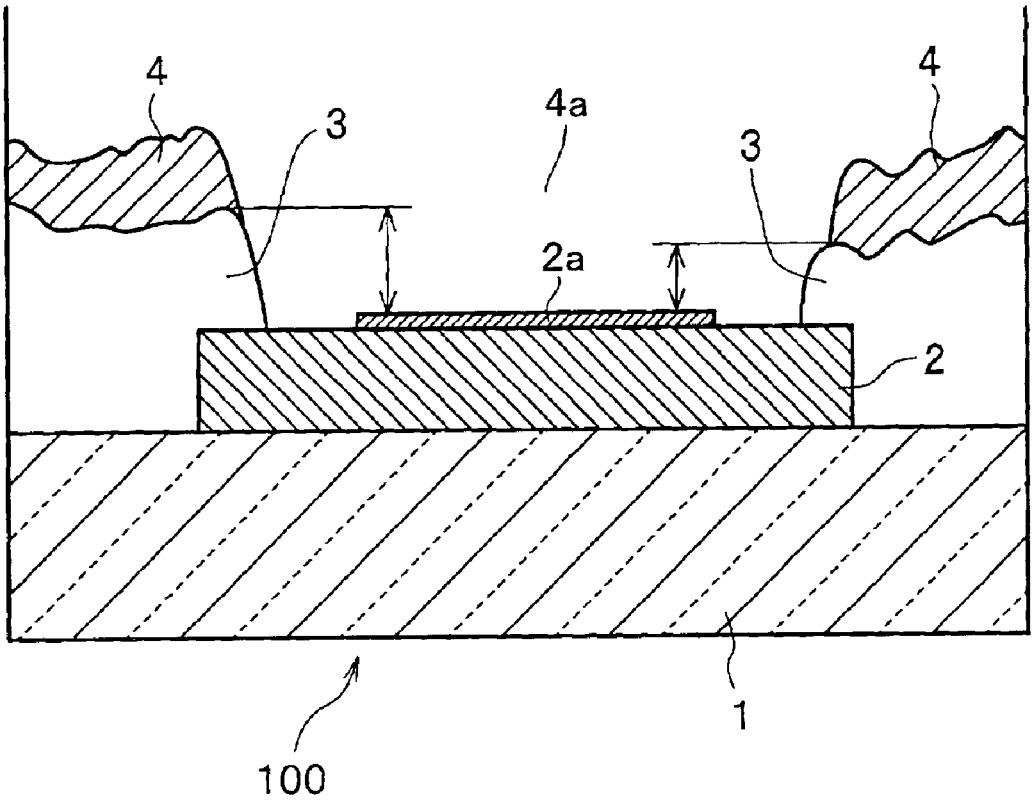
FIG. 41 PRIOR ART
FIG. 41 is an enlarged cross-sectional view of one pixel portion for explaining a constitutional example of a rear panel of a conventional field emission type display device.

FIG. 37 is an equivalent circuit for explaining a driving method of the display device according to the present invention. In this display device, n pieces of cathode wires 2 extending in the y direction are arranged in parallel in the x direction. Further, m pieces of control electrodes 4 extending in the x direction are arranged in parallel in the y direction thus constituting a matrix array of m rows×n columns together with the cathode wires 2.

On a periphery of a rear panel which constitutes the display device, a scanning circuit 40 and a video signal circuit 20 are arranged. Respective control electrodes 4 are connected to the scanning circuit 40 at control electrode terminals 41 (Y1, Y2, . . . Ym) and respective cathode wires 2 are connected to the video signal circuit 20 at cathode terminals 21 (X1, X2, . . . Xn).

The electron emitting source 2*a* which has been explained in the above-mentioned embodiments is provided to each one of pixels arranged in a matrix array. R, G, B in the drawing respectively correspond to the pixels of red, green and blue, and lights which correspond to respective colors are made to be emitted from fluorescent materials.

Synchronous signals 42 are inputted to the scanning circuit 40. The scanning circuit 40 is connected to the control electrodes 41 through the control electrode terminals 41 and applies a scanning signal voltage to the control electrodes 4 by selecting the row of the matrix.

On the other hand, video signals 22 are inputted to the video signal circuit 20. The video signal circuit 20 is connected to the cathode wires 2 through the cathode terminals 21 (X1, X2, . . . Xn) and applies voltages to the cathode wires 2 by selecting rows of the matrix in response to the video signals 22. Accordingly, given pixels which are sequentially selected by the control electrodes 4 and the cathode wires 2 emit light with given colors thus displaying two-dimensional images. Due to the display device having the constitutional example of the present invention, a flat panel type display device which can be driven at a relatively low voltage and exhibits high efficiency can be realized.

Here, although the first adhesive agent 14 and the second adhesive agent 15 are used in the respective embodiments which have been explained heretofore, it is possible to adopt the anodic bonding technique as a method for fixing the control electrode 4 and the rear substrate 1. It is also possible to adopt the anodic bonding technique similarly for fixing the gap holding member 9 and the control electrode 4.

Further, with respect to respective embodiments which have been explained in conjunction with FIG. 1 to FIG. 33, the case in which the insulation layer 3 is not formed between the first contact portion 10, the second contact portion 11 and the third contact portion 12 and the rear substrate 1 has been explained. However, the insulation layer 3 may be formed between these contact portions and the rear substrate 1. Also in this case, due to the rigidity of the control electrodes 4 per se of the plate members, the irregularities of the gap can be reduced. Further, due to the provision of the first contact portion 10, the second contact portion 11 and the third contact portion 12 which project toward the rear substrate 1 side and the recessed portions 4*c,* the insulation layer 3 which is necessary for obtaining the given gap can be made thin and hence, the irregularities of the thickness of the insulation layer 3 can be reduced.

As has been explained heretofore, according to the present invention, by forming the control electrodes 4 using plate-like members and by assembling the control electrodes 4 to the rear substrate 1 and, at the same time, by providing the gap holding members 9 between the rear panel 100 and the face panel 200 with high accuracy, the gap can be held to a predetermined value with high accuracy so that the display device with high reliability can be provided.

What is claimed is:

1. A display device comprising:

a rear panel having a rear substrate, a plurality of cathode wires having electron emitting sources formed on an inner surface of the rear substrate, and a plurality of control electrodes which cross the cathode wires and control an emission quantity of electrons from the electron emitting sources in response to the potential difference between the cathode wires and the control electrodes, a face panel having anodes and fluorescent materials, wherein the control electrodes are formed of plate members, the control electrodes have holes which allow the electrons emitted from the electron emitting sources to pass therethrough toward the face panel side in pixel regions where the control electrodes cross the cathode wires, the control electrodes include contact portions which are projected toward the rear panel side between the neighboring cathode wires and support the control electrodes, gap holding members hold a gap formed between the face panel and the rear panel to a predetermined value right above the contact portions of the control electrodes and at the face panel side, and wherein recessed portions are formed in the cathode wire sides of the control electrodes including hole forming regions.

2. A display device according to claim 1 wherein at least portions of respective contact portions of the control electrodes are fixed to the rear panel by an adhesive agent or an anodic bonding.

3. A display device according to claim 1, wherein the contact portions include first contact portions and second contact portions and the gap holding members are provided right above the first contact portions of the control electrodes and at the face panel side.

4. A display device according to claim 1, wherein the control electrodes include grooves into which ends of the gap holding members are fitted right above the contact portions of the control electrodes and at the face panel side.

5. A display device according to claim 1, wherein the cathode wires are divided in two or more in the pixel region, the control electrodes have third contact portions which are projected to the rear panel side and support the control electrodes, and the third contact portions are arranged between the divided cathode wires.

6. A display device according to claim 1, wherein the cathode wires have an opening in the pixel region, the control electrodes have third contact portions which are projected to the rear panel side and support the control electrodes, and the third contact portions are arranged in the opening formed in the cathode wires.

7. A display device according to claim 1, wherein the control electrodes and the gap holding members are fixed to each other by an adhesive agent or an anodic bonding.

8. A display device according to claim 1, wherein the gap holding members are supported at a given interval from each other by a support member which crosses the cathode wires.

9. A display device according to claim 1, wherein the each gap holding member has plate portions which are arranged in parallel to the cathode wires and the control electrodes respectively among neighboring pixel regions and has an approximately cruciform cross section on a plane of a direction parallel to the cathode wires and the control electrodes.

10. A display device according to claim 1, wherein the contact portions are brought into contact with the rear substrate.

11. A display device according to claim 1, wherein an insulation layer is interposed between the contact portions and the rear substrate.

12. A display device according to claim 1, wherein a width of the recessed portions is set smaller than a width of the control electrodes and an insulation layer is interposed between portions of the control electrodes other than the recessed portions and the cathode wires.

13. A display device according to claim 1, wherein a tension is applied to the control electrodes in the longitudinal direction of the control electrodes.

14. A display device comprising:

a rear panel having a rear substrate, a plurality of cathode wires having electron emitting sources formed on an inner surface of the rear substrate, and a plurality of control electrodes which cross the cathode wires and control an emission quantity of electrons from the electron emitting sources in response to the potential difference between the cathode wires and the control electrodes, a face panel having anodes and fluorescent materials, wherein the control electrodes are formed of plate members, the control electrodes have holes which allow the electrons emitted from the electron emitting sources to pass therethrough toward the face panel side in pixel regions where the control electrodes cross the cathode wires, the control electrodes include contact portions which are projected toward the rear panel side between the neighboring cathode wires and support the control electrodes, gap holding members hold a gap formed between the face panel and the rear panel to a predetermined value right above the contact portions of the control electrodes and at the face panel side, wherein the gap holding members are supported at a given interval from each other by a support member which crosses the cathode wires, and wherein the support member has cuts into which side peripheries of the gap holding members extending in the gap holding direction are fitted.

15. A display device comprising:

a rear panel having a rear substrate, a plurality of cathode wires having electron emitting sources formed on an inner surface of the rear substrate, and a plurality of control electrodes which cross the cathode wires and control an emission quantity of electrons from the electron emitting sources in response to the potential difference between the cathode wires and the control electrodes, a face panel having anodes and fluorescent materials, wherein the control electrodes are formed of plate members, the control electrodes have holes which allow the electrons emitted from the electron emitting sources to pass therethrough toward the face panel side in pixel regions where the control electrodes cross the cathode wires, the control electrodes include contact portions which are projected toward the rear panel side between the neighboring cathode wires and support the control electrodes, gap holding members hold a gap formed between the face panel and the rear panel to a predetermined value right above the contact portions of the control electrodes and at the face panel side, wherein the gap holding members are supported at a given interval from each other by a support member which crosses the cathode wires, and wherein the support member is arranged between the control electrodes and at positions where the control electrodes cross the gap holding members and have cuts into which end peripheries of the gap holding members at the cathode wire-side are fitted.

* * * * *